US008213836B2

(12) United States Patent
Kato et al.

(10) Patent No.: US 8,213,836 B2
(45) Date of Patent: Jul. 3, 2012

(54) DEVELOPING DEVICE AND IMAGE FORMING APPARATUS

(75) Inventors: Tomohiro Kato, Okazaki (JP); Junji Murauchi, Toyokawa (JP); Megumi Minami, Amagasaki (JP); Tomoyuki Imura, Toyohashi (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 660 days.

(21) Appl. No.: 12/332,451

(22) Filed: Dec. 11, 2008

(65) Prior Publication Data

US 2009/0214266 A1 Aug. 27, 2009

(30) Foreign Application Priority Data

Feb. 21, 2008 (JP) ..... 2008-039748

(51) Int. Cl.
*G03G 15/08* (2006.01)

(52) U.S. Cl. ..... 399/254; 399/258

(58) Field of Classification Search ..... 399/254, 399/255, 256, 257, 258
See application file for complete search history.

(56) References Cited

U.S. PATENT DOCUMENTS 4,721,982 A 1/1988 Ueda
4,864,349 A * 9/1989 Ito ..... 399/256
5,430,532 A 7/1995 Ueda et al.
5,572,299 A 11/1996 Kato et al.
5,682,583 A * 10/1997 Ito et al. ..... 399/254
5,963,766 A 10/1999 Okuno et al.
7,046,945 B2 * 5/2006 Nishitani et al. ..... 399/254
7,426,360 B2 * 9/2008 Arimoto et al. ..... 399/254

(Continued)

FOREIGN PATENT DOCUMENTS

JP 59-100471 A 6/1984

(Continued)

OTHER PUBLICATIONS

English translation of a Third Office Action issued in corresponding Japanese Patent Application No. 2008-039748 dated Oct. 12, 2010.

(Continued)

*Primary Examiner* — Robert Beatty
(74) *Attorney, Agent, or Firm* — Buchanan Ingersoll & Rooney PC

(57) ABSTRACT

The present invention provides a developing device and an image forming apparatus capable of preventing a developer from being discharged excessively using simple configurations in the case that a trickle developing device that uses a two-component developer is in a tilted state. The developing device having stirring members for conveying and stirring a developer and a developer holder, comprises a developer replenishing tank for replenishing the developer to a developer tank and a trickle discharging mechanism, wherein the conveying passages thereof include an upper conveying passage, a lower conveying passage, a first communicating passage for connecting the downstream side of the upper conveying passage to the upstream side of the lower conveying passage, and a second communicating passage for connecting the downstream side of the lower conveying passage to the upstream side of the upper conveying passage, and also include a circulation passage through which the developer circulates using the upper conveying passage, the first communicating passage, the lower conveying passage and the second communicating passage; the discharging mechanism is disposed in the downstream end section of the upper conveying passage; the bottom face on the downstream side of the upper conveying passage is positioned above the bottom face on the upstream side of the lower conveying passage; and the first communicating passage is disposed obliquely downward with respect to the horizontal plane.

26 Claims, 19 Drawing Sheets

U.S. PATENT DOCUMENTS

| | | | | |
|---|---|---|---|---|
| 7,650,101 | B2 * | 1/2010 | Hosokawa et al. | 399/254 |
| 7,783,232 | B2 * | 8/2010 | Minami et al. | 399/255 |
| 7,904,001 | B2 * | 3/2011 | Tateyama et al. | 399/254 |
| 2003/0026628 | A1 | 2/2003 | Arimoto | |
| 2004/0114966 | A1 | 6/2004 | Masuda | |
| 2006/0029432 | A1 | 2/2006 | Arimoto et al. | |

FOREIGN PATENT DOCUMENTS

| | | | | |
|---|---|---|---|---|
| JP | 63193165 | A | * | 8/1988 |
| JP | 04-060565 | | | 2/1992 |
| JP | 05-127537 | | | 5/1993 |
| JP | 11-024404 | | | 1/1999 |
| JP | 11-065279 | A | | 3/1999 |
| JP | 11-231624 | A | | 8/1999 |
| JP | 2000-098724 | | | 4/2000 |
| JP | 2000-112238 | | | 4/2000 |
| JP | 2005-221852 | | | 8/2005 |
| JP | 2005-292511 | | | 10/2005 |
| JP | 2006-047884 | | | 2/2006 |
| JP | 2006-323238 | | | 11/2006 |
| JP | 2007-047248 | | | 2/2007 |
| JP | 2007-147807 | A | | 6/2007 |

OTHER PUBLICATIONS

Notification of Reason for Refusal issued in the corresponding Japanese Patent Application No. 2008-039748 dated Mar. 2, 2010, and an English translation thereof.

European Search Report in corresponding Application No. 09153299.4-2209 dated Jun. 3, 2009.

Notification of Reason for Refusal dated Jul. 6, 2010, issued in the corresponding Japanese Patent Application No. 2008-039748, and an English Translation thereof.

* cited by examiner

DEVELOPING DEVICE AND IMAGE FORMING APPARATUS

This application is based on applications No. 2008-39748 filed in Japan, the contents of which are hereby incorporated by reference.

BACKGROUND OF THE INVENTION

1. Field of the Invention

The present invention relates to a developing device for use in an electrophotographic image forming apparatus and to an image forming apparatus incorporating the developing device. More particularly, the present invention relates to a trickle developing device that gradually supplies fresh developer and gradually discharge deteriorated developer and to an image forming apparatus incorporating the developing device.

2. Description of the Related Art

As developing systems employed for electrophotographic image forming apparatuses, the one-component developing system in which toner is used as the main component of the developer and the two-component developing system in which toner and carrier are used as the main components of the developer are known.

The two-component developing system that uses toner and carrier, in which the toner and carrier are charged by friction contact therebetween to predetermined polarities, has a characteristic that the stress on the toner is less than that in the one-component developing system that uses a one-component developer. Since the surface area of the carrier is larger than that of the toner, the carrier is less contaminated with the toner attached to the surface thereof. However, with the use for a long period, contamination (spent) attached to the surface of the carrier increases, whereby the capability of charging the toner is reduced gradually. As a result, problems of photographic fog and toner scattering occur. Although it is conceivable that the amount of the carrier stored in a two-component developing device is increased to extend the life of the developing device, this is undesirable because the developing device becomes larger in size.

To solve the problems encountered in the two-component developer, Patent document 1 discloses a trickle developing device being characterized in that fresh developer is gradually replenished into the developing device and developer deteriorated in charging capability is gradually discharged from the developing device, whereby the increase of the deteriorated carrier is suppressed. The developing device is configured to maintain the volume level of the developer inside the developing device approximately constant by discharging an excessive amount of deteriorated developer using the change in the volume of the developer. In the trickle developing device, the deteriorated carrier inside the developing device is gradually replaced with fresh carrier, and the charging performance of the carrier inside the developing device can be maintained approximately constant.

Furthermore, in a trickle developing device that uses a two-component developer, such a developing device as disclosed in Patent document 2 is proposed in which fluctuation of the discharge amount of the developer contained in a developer container due to tilting of the developer container is prevented.

In other words, the developing device according to Patent document 2 comprises a developer container equipped with a developer discharge port located at a position which is below the upper face level of the developer inside the developer container and in which the developer is always present; a developer discharge cylinder provided with a discharge port connecting section connected to a developer discharge port at one end thereof and a recovery container communicating section at the other end thereof; and a discharged developer conveying member for conveying the developer discharged from the developer discharge port and stored inside the developer discharge cylinder in a state of closing the discharge port connecting section toward the recovery container communicating section.

[Patent document 1] Japanese Patent Application Laid-Open Publication No. Sho 59-100471

[Patent document 2] Japanese Patent Application Laid-Open Publication No. Hei 11-065279

In the developing device disclosed in Patent document 2, the developer discharged into the developer discharge cylinder closes the discharge port connecting section to prevent further discharge of the developer, the discharged developer conveying member is driven to convey the developer closing the discharge port connecting section toward the recovery container communicating section located at the other end, and the developer newly delivered is discharged into the space emptied by the conveying. Furthermore, when the distribution of the amount of the developer inside the developer container becomes uneven due to the tilting or the like of the developer inside the developer container, the amount of the developer to be discharged from the developer container to the developer discharge cylinder is controlled by adjusting the rotation speed, the rotation operation time, etc. of the discharged developer conveying member.

In the developing device disclosed in Patent document 2, the amount of the developer to be discharged from the developer container to the developer discharge cylinder is controlled by adjusting the rotation speed, the rotation operation time, etc. of the discharged developer conveying member on the basis of the information on the tilting or the like of the developer inside the developer container. Hence, the developing device of Patent document 2 has problems such that some kind of detecting device is necessary to obtain the information on the tilting or the like of the developer inside the developer container and such that the control for the rotation speed, the rotation operation time, etc. of the discharged developer conveying member on the basis of the information obtained using the detecting device is complicated.

Accordingly, the technical problem to be solved by the present invention is to provide a developing device and an image forming apparatus capable of preventing the developer from being discharged excessively by using a simple configuration in the case that a trickle developing device that uses a two-component developer is in a tilted state.

SUMMARY OF THE INVENTION

To solve the above-mentioned technical problem, the present invention provides a developing device having stirring members for stirring a developer-tank-contained developer containing toner and carrier inside a developer tank while conveying the developer along conveying passages and a developer holder disposed adjacent to the stirring members to supply the stirred developer-tank-contained developer to an electrostatic latent image holder, comprising:

a developer replenishing tank for replenishing the toner and the carrier to the developer tank, and a discharging mechanism for discharging an excessive amount of the developer-tank-contained developer outside the developer tank from a discharge opening section when the amount of the developer-tank-contained developer to be conveyed using the stirring members inside the developer tank exceeds a predetermined amount, wherein the stirring members comprise an upper stirring member and a lower stirring member disposed so as to be opposed to the upper stirring member, the conveying passages include an upper conveying passage in which the upper stirring member is disposed, a lower conveying passage in which the lower stirring member is disposed, a circulating flow outlet provided in a side wall on the downstream side of the upper conveying passage and on the side opposed to the lower conveying passage and a second communicating passage for connecting the downstream side of the lower conveying passage to the upstream side of the upper conveying passage, and also include a circulation passage through which the developer-tank-contained developer circulates using the upper conveying passage, the circulating flow outlet, the lower conveying passage and the second communicating passage, the discharging mechanism is disposed in the downstream end section of the upper conveying passage, and the circulating flow outlet is positioned above the level of the developer-tank-contained developer conveyed on the upstream side of the lower conveying passage.

When a developing device having the so-called trickle discharging mechanism is in a horizontal state, ordinary discharging operation is carried out using the trickle discharging mechanism. When the developing device is in a tilted state in which the developing device urges the developer-tank-contained developer to be discharged, that is, when the developing device is disposed obliquely such that the discharge side thereof is positioned low, a conveying amount due to the gravitational action applied to the developer is added to the discharge amount discharged to the discharging mechanism in the horizontal state. As a result, the total discharge amount of the developer to the discharging mechanism increases.

On the other hand, in the developing device according to the present invention, the trickle discharging mechanism is disposed in the downstream end section of the upper conveying passage, and the circulating flow outlet is configured so as to be positioned above the level of the developer conveyed on the upstream side of the lower conveying passage. In other words, a level difference is formed between the level of the developer conveyed in the upper conveying passage and the level of the developer conveyed in the lower conveying passage. The developer is pushed out from the circulating flow outlet provided in the side wall of the upper conveying passage by the conveying force of the upper stirring member and flows down from the circulating flow outlet to the lower conveying passage. The circulating flow outlet described above functions as part of the ordinary circulation passages at the time of the horizontal disposition and also functions as a guide passage for guiding the developer having been conveyed near the circulating flow outlet to the circulation passage at the time of the tilted disposition. Since part of the increased amount of the developer conveyed toward the trickle discharging mechanism is returned to the circulation passage under the guidance of the circulating flow outlet, excessive discharge of the developer to the trickle discharging mechanism can be restricted.

In order that the circulating flow outlet functions as the above-mentioned guide passage, the downstream side of the upper conveying passage is at least required to be positioned above the upstream side of the lower conveying passage.

Hence, the bottom face of the upper conveying passage is configured so as to be nearly parallel with the bottom face of the lower conveying passage, and the outside diameter of the lower stirring member is configured so as to be larger than the outside diameter of the upper stirring member.

Alternatively, the distance between the bottom face of the upper conveying passage and the bottom face of the lower conveying passage is configured so as to become larger on the side of the circulating flow outlet and become smaller on the side of the second communicating passage, and the outside diameter of the upper stirring member is configured so as to be substantially identical with the outside diameter of the lower stirring member.

Alternatively, the distance between the bottom face of the upper conveying passage and the bottom face of the lower conveying passage is configured so as to become larger on the side of the circulating flow outlet and become smaller on the side of the second communicating passage, and the outside diameter of the lower stirring member is configured so as to be larger than the outside diameter of the upper stirring member on the side of the circulating flow outlet.

Alternatively, the distance between the bottom face of the upper conveying passage and the bottom face of the lower conveying passage is configured so as to become larger on the side of the circulating flow outlet and become smaller on the side of the second communicating passage, and the outside diameter of the lower stirring member is configured so as to be large at the portion on the side of the circulating flow outlet, be small at the portion on the side of the second communicating passage and gradually become smaller in the intermediate portion thereof.

The pitch at the portion of the upper stirring member close to the discharging mechanism is configured so as to be larger than that at the other portions of the upper stirring member. With the above-mentioned configuration, air is apt to be captured easily around the developer at the large pitch portion on the downstream side of the upper stirring member. Since the developer holding air has high fluidity, the developer is easily guided to the circulating flow outlet.

The above-mentioned developing device is incorporated and used in an image forming apparatus having a rotatable electrostatic latent image holder for holding electrostatic latent images on the circumferential face thereof.

Furthermore, to solve the above-mentioned technical problem, the present invention provides a developing device having stirring members for stirring a developer-tank-contained developer containing toner and carrier inside a developer tank while conveying the developer along conveying passages and a developer holder disposed adjacent to the stirring members to supply the stirred developer-tank-contained developer to an electrostatic latent image holder, comprising:

a developer replenishing tank for replenishing the toner and the carrier to the developer tank, and a discharging mechanism for discharging an excessive amount of the developer-tank-contained developer outside the developer tank from a discharge opening section when the amount of the developer-tank-contained developer to be conveyed using the stirring members inside the developer tank exceeds a predetermined amount, wherein the stirring members comprise an upper stirring member and a lower stirring member disposed so as to be opposed to the upper stirring member, the conveying passages include an upper conveying passage in which the upper stirring member is disposed, a lower conveying passage in which the lower stirring member is disposed, a first communicating passage for connecting the downstream side of the upper conveying passage to the upstream side of the lower conveying passage and a second communicating passage for connecting the downstream side of the lower conveying passage to the upstream side of the upper conveying passage, and also include a circulation passage through which the developer-tank-contained developer circulates using the upper conveying passage, the first communicating passage, the lower conveying passage and the second communicating passage, the discharging mechanism is disposed in the downstream end section of the upper conveying passage, the bottom face on the downstream side of the upper conveying passage is positioned above the bottom face on the upstream side of the lower conveying passage, and the first communicating passage is disposed obliquely downward with respect to the horizontal plane.

When a developing device having the so-called trickle discharging mechanism is in a horizontal state, ordinary discharging operation is carried out using the trickle discharging mechanism. When the developing device is in a tilted state in which the developing device urges the developer-tank-contained developer to be discharged, that is, when the developing device is disposed obliquely such that the discharge side thereof is positioned low, a conveying amount due to the gravitational action applied to the developer is added to the discharge amount discharged to the discharging mechanism in the horizontal state. As a result, the total discharge amount of the developer to the discharging mechanism increases.

On the other hand, in the developing device according to the present invention, the trickle discharging mechanism is disposed in the downstream end section of the upper conveying passage, and the bottom face on the downstream side of the upper conveying passage is positioned above the bottom face on the upstream side of the lower conveying passage, whereby the first communicating passage is disposed obliquely downward with respect to the horizontal plane. The first communicating passage tilted obliquely downward with respect to the horizontal plane functions as an ordinary circulation passage at the time of the horizontal disposition and also functions as a guide passage for guiding part of the developer having been conveyed near the first communicating passage to the circulation passage at the time of the tilted disposition. In addition to the conveying force of the upper stirring member, the gravitational force applied to the developer acts on the developer having been conveyed near the first communicating passage. The developer on which the conveying force and the gravitational force act falls down obliquely along the first communicating passage. Hence, the force of guiding the developer existing in the upper conveying passage to the lower conveying passage in the case that the first communicating passage tilted obliquely downward is provided becomes larger than that in the case that the circulating flow outlet is provided. Since part of the increased amount of the developer conveyed toward the trickle discharging mechanism is returned to the circulation passage under the guidance of the first communicating passage, excessive discharge of the developer to the trickle discharging mechanism can be restricted.

In order that the first communicating passage functions as the above-mentioned guide passage, the bottom face of the upper conveying passage is at least required to be positioned above the bottom face on the upstream side of the lower conveying passage. The disposition between the upper conveying passage and the lower conveying passage can be configured variously; however, for example, the bottom face of the upper conveying passage is configured so as to be nearly parallel with the bottom face of the lower conveying passage. With the configuration described above, the developing device can be designed easily.

In the case that the bottom face of the upper conveying passage is nearly parallel with the bottom face of the lower conveying passage, the outside diameter of the upper stirring member and the outside diameter of the lower stirring member are configured so as to be substantially identical. With the configuration described above, the common use of the upper stirring member and the lower stirring member is substantially possible, whereby parts control can be facilitated and cost can be reduced. In addition, since the stirring members being compact in size can be used, space saving can be achieved for the developing device.

As a variation example in which the outside diameters of the upper and lower stirring members are substantially identical, the outside diameter of the lower stirring member is configured so as to be larger than the outside diameter of the upper stirring member.

As a variation example in which the bottom face of the upper conveying passage is nearly parallel with the bottom face of the lower conveying passage, the distance between the bottom face of the upper conveying passage and the bottom face of the lower conveying passage is configured so as to become larger on the side of the first communicating passage and become smaller on the side of the second communicating passage. With the configuration described above, a space is formed at the portion on the lower side of the second communicating passage, and space saving can be achieved for the developing device.

In the case that the distance between the bottom face of the upper conveying passage and the bottom face of the lower conveying passage is configured so as to become larger on the side of the first communicating passage and become smaller on the side of the second communicating passage, the outside diameter of the upper stirring member and the outside diameter of the lower stirring member are configured so as to be substantially identical. With the configuration described above, the common use of the upper stirring member and the lower stirring member is substantially possible, whereby parts control can be facilitated and cost can be reduced.

As a variation example in which the outside diameters of the upper and lower stirring members are substantially identical, the outside diameter of the lower stirring member is configured so as to be larger than the outside diameter of the upper stirring member on the side of the first communicating passage.

In the case that the outside diameter of the lower stirring member is larger than the outside diameter of the upper stirring member on the side of the first communicating passage, the outside diameter of the lower stirring member is configured so as to gradually become smaller from the side of the first communicating passage toward the side of the second communicating passage. Furthermore, the outside diameter of the lower stirring member is configured so as to be large at the portion on the side of the first communicating passage, be small at the portion on the side of the second communicating passage and gradually become small at the intermediate portion thereof.

In order that the first communicating passage functions as a guiding passage at the time of the tilted disposition so as to guide an appropriate amount of the developer, the tilt angle of the first communicating passage tilted obliquely downward with respect to the horizontal plane is preferably 10 to 60 degrees.

The tilt angle of the first communicating passage tilted obliquely downward with respect to the horizontal plane is further preferably 20 to 40 degrees.

The pitch at the portion of the upper stirring member close to the discharging mechanism is configured so as to be larger than that at the other portions of the upper stirring member. With the above-mentioned configuration, air is apt to be captured easily around the developer at the large pitch portion on the downstream side of the upper stirring member. Since the developer holding air has high fluidity, the developer is easily guided to the first communicating passage. Hence, the effect of guiding the developer to the first communicating passage can be obtained without making the tilt angle of the first communicating passage much larger.

The above-mentioned developing device is incorporated and used in an image forming apparatus having a rotatable electrostatic latent image holder for holding electrostatic latent images on the circumferential face thereof.

DESCRIPTION OF THE PREFERRED EMBODIMENT

Figure 1:
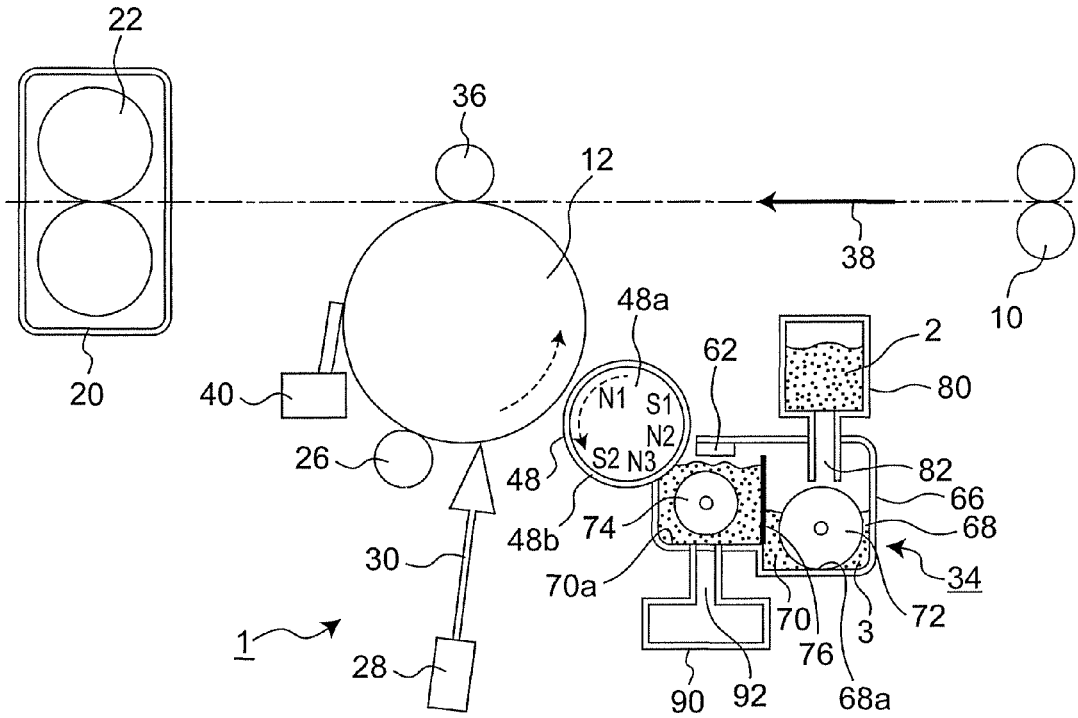
FIG. 1 is a view showing the schematic configuration of an image forming apparatus according to a first embodiment of the present invention.

Preferred embodiments according to the present invention will be described below referring to the accompanying drawings. Although terms meaning specific directions (for example, "above," "below," "left" and "right" and other terms including these, and "clockwise" and "counterclockwise") are used in the following description, they are used for purposes of facilitating the understanding of the present invention referring to the drawings, and it should not be construed that the present invention is limited by the meanings of the terms. Furthermore, in an image forming apparatus 1 and a developing device 34 described below, identical or similar components are designated by the same reference numerals.

The image forming apparatus 1 and the developing device 34 incorporated therein according to a first embodiment of the present invention will be described referring to FIGS. 1 to 7.

[Image Forming Apparatus]

FIG. 1 shows the components relating to image formation in the electrophotographic image forming apparatus 1 according to the first embodiment of the present invention. The image forming apparatus 1 may be a copier, a printer, a facsimile machine or a compound machine combinedly equipped with the functions of these. The image forming apparatus 1 has a photosensitive member 12 serving as an electrostatic latent image holder. Although the photosensitive member 12 is formed of a cylinder in this embodiment, the photosensitive member 12 is not limited to have such a shape in the present invention, but it is possible to use an endless belt-type photosensitive member instead. The photosensitive member 12 is connected to a motor (not shown) so as to be driven and is rotated on the basis of the driving of the motor in the direction indicated by the arrow. Around the circumference of the photosensitive member 12, a charging device 26, an exposure device 28, a developing device 34, a transfer device 36 and a cleaning device 40 are respectively arranged along the rotation direction of the photosensitive member 12.

The charging device 26 charges the photosensitive layer, that is, the outer circumferential face of the photosensitive member 12, to a predetermined potential. Although the charging device 26 is represented as a cylindrical roller in this embodiment, instead of this, it is also possible to use charging devices of other forms (for example, a rotary or fixed brush type charging device and a wire discharging type charging device). The exposure device 28 disposed at a position close to or away from the photosensitive member 12 emits image light 30 toward the outer circumferential face of the charged photosensitive member 12. An electrostatic latent image having an area wherein the image light 30 is projected and the charged potential is attenuated and an area wherein the charged potential is almost maintained is formed on the outer circumferential face of the photosensitive member 12 that has passed the exposure device 28. In this embodiment, the area wherein the charged potential is attenuated is the image area of the electrostatic latent image, and the area wherein the charged potential is almost maintained is the non-image area of the electrostatic latent image. The developing device 34 develops the electrostatic latent image into a visible image using a developer-tank-contained developer 3 described later. The details of the developing device 34 are described later. The transfer device 36 transfers the visible image formed on the outer circumferential face of the photosensitive member 12 onto paper 38 or film. Although the transfer device 36 is shown as a cylindrical roller in the embodiment shown in FIG. 1, it is also possible to use transfer devices having other forms (for example, a wire discharging type transfer device). The cleaning device 40 recovers non-transferred toner not transferred to the paper 38 by the transfer device 36 but remaining on the outer circumferential face of the photosensitive member 12 from the outer circumferential face of the photosensitive member 12. Although the cleaning device 40 is shown as a plate-like blade in this embodiment, instead of this, it is also possible to use cleaning devices having other forms (for example, a rotary or fixed brush-type cleaning device).

When the image forming apparatus 1 configured as described above forms an image, the photosensitive member 12 is rotated counterclockwise, for example, on the basis of the driving of the motor (not shown). At this time, the outer circumferential area of the photosensitive member 12 passing the charging device 26 is charged to a predetermined potential at the charging device 26. The outer circumferential area of the charged photosensitive member 12 is exposed to the image light 30 at the exposure device 28, and an electrostatic latent image is formed. As the photosensitive member 12 is rotated, the electrostatic latent image is conveyed to the developing device 34 and developed into a visible image using the developing device 34. As the photosensitive member 12 is rotated, the toner image developed into the visible image is conveyed to the transfer device 36 and transferred to the paper 38 using the transfer device 36. The paper 38 to which the toner image is transferred is conveyed to a fixing device 20, and the toner image is fixed to the paper 38. The outer circumferential area of the photosensitive member 12 having passed the transfer device 36 is conveyed to the cleaning device 40 in which the toner not transferred to the paper 38 but remaining on the outer circumferential face of the photosensitive member 12 is scraped off from the photosensitive member 12.

[Developing Device]

The developing device 34 is provided with a two-component developer containing non-magnetic toner (hereafter simply referred to as toner) and magnetic carrier (hereafter simply referred to as carrier) and a developer tank 66 accommodating various members. The developer tank 66 has an opening section being open toward the photosensitive member 12, and a developing roller 48 is installed in a space formed near the opening section. The developing roller 48 serving as a developer holder is a cylindrical member that is rotatably supported in parallel with the photosensitive member 12 while having a predetermined developing gap to the outer circumferential face of the photosensitive member 12.

The developing roller 48 is the so-called magnetic roller having a magnet 48*a* secured so as not to be rotatable and a cylindrical sleeve 48*b* (first rotating cylinder) supported so as to be rotatable around the circumference of the magnet 48*a*. Above the sleeve 48*b* of the developing roller 48, a regulating plate 62 secured to the developer tank 66 and extending in parallel with the center axis of the sleeve 48*b* of the developing roller 48 is disposed so as to be opposed thereto with a predetermined regulating gap therebetween. The magnet 48*a* disposed inside the developing roller 48 has five magnetic poles N1, S2, N3, N2 and S1 in the rotation direction of the sleeve 48*b*. Among these magnetic poles, the main magnetic pole N1 is disposed so as to be opposed to the photosensitive member 12. The magnetic poles N2 and N3 having the same polarity and generating a repulsive magnetic field for detaching the developer from the surface of the sleeve 48*b* are disposed so as to be opposed to each other inside the developer tank 66. The sleeve 48*b* of the developing roller 48 rotates in the direction opposite to the rotation direction of the photosensitive member 12 (counter direction).

Figure 2:
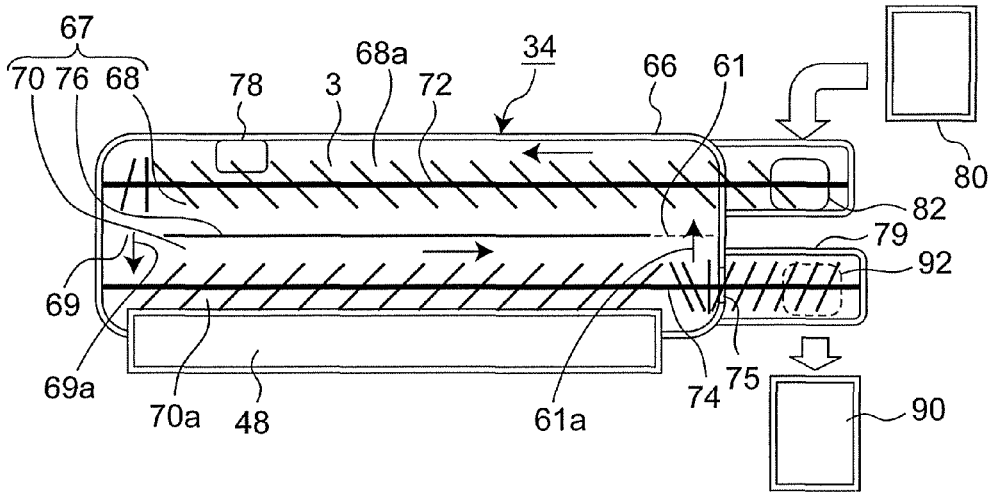
FIG. 2 is a schematic sectional view showing the developing device of the image forming apparatus shown in FIG. 1 as seen from above.

FIG. 2 is a schematic sectional view showing the developing device 34 as seen from above. As shown in FIG. 2, a developer stirring and conveying chamber 67 is formed behind the developing roller 48. The developer stirring and conveying chamber 67 comprises an upper conveying passage 70 formed near the developing roller 48, a lower conveying passage 68 formed away from the developing roller 48 and a partition wall 76 for partitioning the space between the lower conveying passage 68 and the upper conveying passage 70. Above the upstream side in the conveying direction of the lower conveying passage 68, a developer replenishing tank 80 is disposed, and the developer replenishing tank 80 communicates with the lower conveying passage 68 via a replenishing port 82. The developer replenishing tank 80 is filled with a replenishment developer 2 containing toner as a major ingredient and carrier. The toner and the carrier may be replenished separately. The ratio of the carrier in the replenishment developer 2 is preferably 5 to 40 wt %, further preferably 10 to 30 wt %. In addition, below the downstream side in the conveying direction of the upper conveying passage 70, a developer recovery tank 90 is disposed, and the upper conveying passage 70 communicates with the developer recovery tank 90 via a recovery port 92.

At the bottom of the developer replenishing tank 80, a developer supplying roller is disposed, the driving operation of which is controlled using a controller 100. When the developer supplying roller is driven and rotated, the replenishment developer 2, which is fresh and the amount of which corresponds to the driving time of the roller, flows downward and is supplied to the lower conveying passage 68 of the developer tank 66.

In the lower conveying passage 68, a first screw 72 serving as a stirring member for conveying the developer-tank-contained developer 3 while stirring the developer is rotatably supported. In the upper conveying passage 70, a second screw 74 for conveying the developer-tank-contained developer 3 from the lower conveying passage 68 to the developing roller 48 while stirring the developer is rotatably supported. In this case, the upper portions of the partition wall 76, located at the end sections on the upstream side of the upper conveying passage 70 and the downstream side of the lower conveying passage 68, are cut out, and communicating passages are formed. In other words, in FIG. 2, a second communicating passage 69 for almost continuously connecting the downstream side of the lower conveying passage 68 to the upstream side of the upper conveying passage 70 is formed on the left side of the partition wall 76. As a result, a circulation passage through which the developer-tank-contained developer 3 circulates is formed using the upper conveying passage 70, an opening section 65 (circulating flow outlet 63) described later, the lower conveying passage 68 and the second communicating passage 69. The developer-tank-contained developer 3 circulates inside the developer stirring and conveying chamber 67 counterclockwise in the direction indicated by the arrow shown in FIG. 2, for example. The upper conveying passage 70 is configured so as to be positioned at a level as high as or higher than the lower conveying passage 68 as described later.

Figure 5:
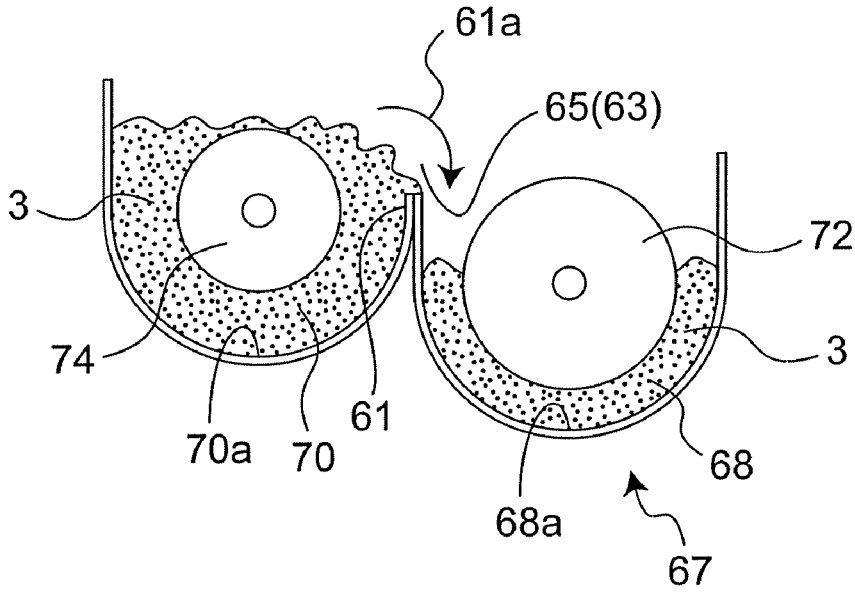
FIG. 5 is a view schematically illustrating the characteristic sections of a developer stirring and conveying chamber according to the first embodiment of the present invention.
Figure 6:
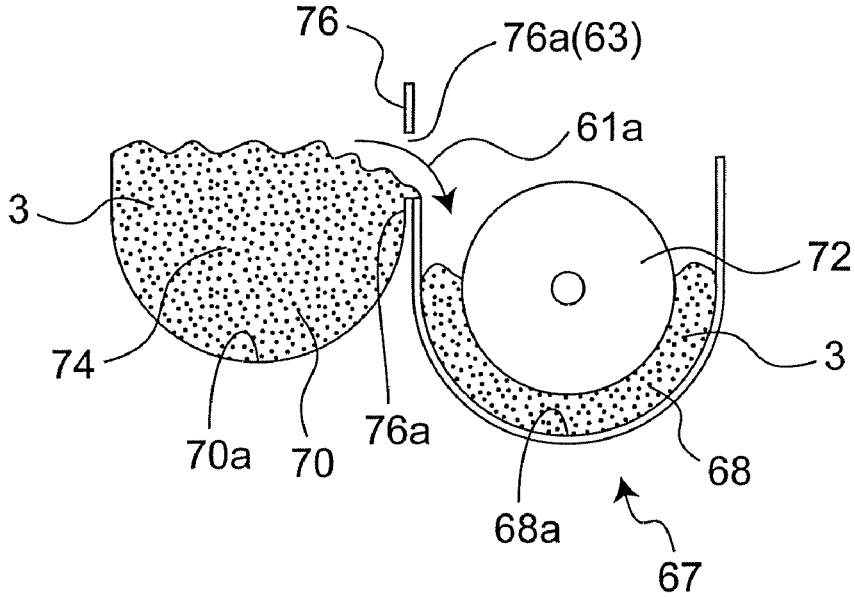
FIG. 6 is a view schematically illustrating the characteristic sections of the developer stirring and conveying chamber according to the first embodiment of the present invention.

As shown in FIGS. 1, 5 and 6, in the developing device 34 according to the first embodiment of the present invention, the upper conveying passage 70 is positioned above the lower conveying passage 68, and the level of the developer-tank-contained developer 3 existing in the upper conveying passage 70 is positioned above the level of the developer-tank-contained developer 3 existing in the lower conveying passage 68. In other words, a level difference is formed between the developer level in the upper conveying passage 70 and the developer level in the lower conveying passage 68. Hence, an overflow space is formed above the level of the developer-tank-contained developer 3 in the lower conveying passage 68 because of the level difference on the basis of the difference between the developer levels in the lower and upper conveying passages 68 and 70. The circulating flow outlet 63 is provided in the side wall on the downstream side of the upper conveying passage 70 and on the side opposed to the lower conveying passage 68 and is positioned above the level of the developer-tank-contained developer 3 conveyed on the upstream side of the lower conveying passage 68. In other words, the upper conveying passage 70 is discontinuously connected to the lower conveying passage 68 via the circulating flow outlet 63 on the downstream side of the upper conveying passage 70. For this reason, the developer-tank-contained developer 3 pushed out from the upper conveying passage 70 by the conveying force of the second screw (upper stirring member) 74 flows down like a waterfall from the circulating flow outlet 63 toward the lower conveying passage 68.

FIGS. 5 and 6 are views schematically illustrating the characteristic sections of the developer stirring and conveying chamber 67 according to the first embodiment of the present invention.

FIG. 5 shows a state in which the developer-tank-contained developer 3 being conveyed toward the downstream side along the upper conveying passage 70 using the second screw (upper stirring member) 74 climbs over the upper end section of a lower wall section 61 and is pushed out toward the lower conveying passage 68. The upper end section of the lower wall section 61 is positioned below the upper end of a cutout (excessive flow outlet) 75 described later. The opening section 65 positioned above the lower wall section 61 functions as the circulating flow outlet 63 constituting part of the circulation passage through which the developer-tank-contained developer 3 is circulated and conveyed. Hence, the developer-tank-contained developer 3 overflowing from the upper conveying passage 70 flows down from the opening section 65 toward the lower conveying passage 68 as indicated by an arrow 61*a*.

Furthermore, FIG. 6 shows a variation example of the characteristic sections shown in FIG. 5 and shows a state in which the developer-tank-contained developer 3 being conveyed toward the downstream side along the upper conveying passage 70 using the second screw (upper stirring member) 74 is pushed out toward the lower conveying passage 68 from a slit-shaped cutout section 76*a* provided in the partition wall 76. The slit-shaped cutout section 76*a* is provided below the upper end of the cutout (excessive flow outlet) 75. The cutout section 76*a* functions as the circulating flow outlet 63 constituting part of the circulation passage through which the developer-tank-contained developer 3 is circulated and conveyed. Hence, the developer-tank-contained developer 3 overflowing from the upper conveying passage 70 flows down from the cutout section 76*a* toward the lower conveying passage 68 as indicated by an arrow 61*a*.

Figure 7A:
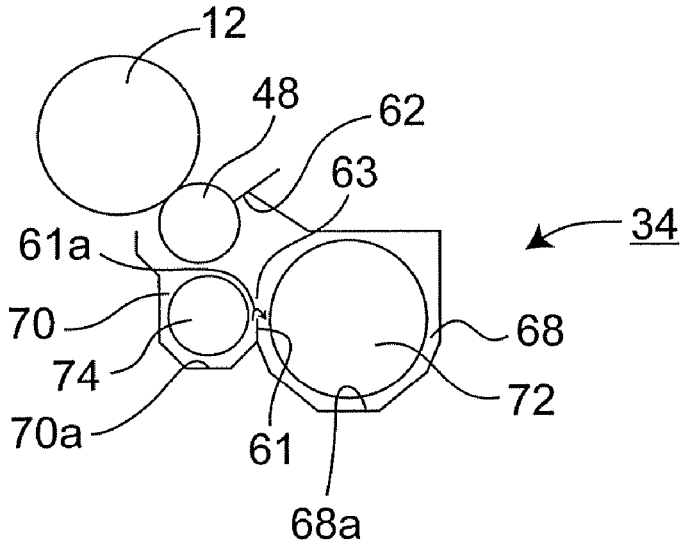
FIG. 7A is a schematic side view showing the developing device as seen from the side of a developer discharging section according to a first embodiment of the present invention.
Figure 7B:
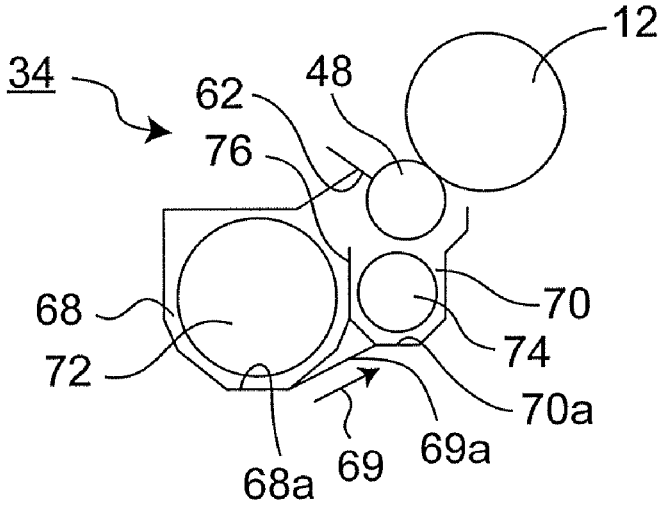
FIG. 7B is a schematic side view showing the developing device as seen from the opposite side of the developer discharging section according to the first embodiment of the present invention.
Figure 7C:
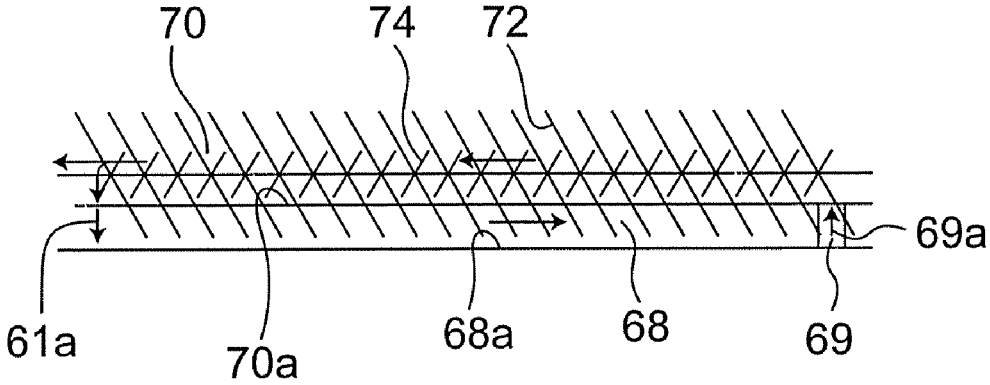
FIG. 7C is a schematic view showing the developing device as seen from the side according to the first embodiment of the present invention.

FIG. 7A is a schematic side view showing the developing device 34 as seen from the side of a developer discharging section 79 according to the first embodiment of the present invention, FIG. 7B is a schematic side view showing the developing device 34 as seen from the opposite side of the developer discharging section 79 according to the first embodiment of the present invention, and FIG. 7C is a schematic view showing the developing device 34 as seen from the side according to the first embodiment of the present invention.

The developing device 34 according to the first embodiment shown in FIGS. 7A, 7B and 7C is configured such that the bottom face 70*a* of the upper conveying passage 70 is nearly parallel with the bottom face 68*a* of the lower conveying passage 68 and such that the outside diameter of the first screw 72 (lower stirring member) is larger than the outside diameter of the second screw 74 (upper stirring member). In the example shown in FIGS. 7A, 7B, and 7C, the rotation shaft of the first screw 72 (lower stirring member) and the rotation shaft of the second screw 74 (upper stirring member) extend on nearly identical horizontal planes; however, the two rotation shafts are not necessarily required to extend on the nearly identical horizontal planes.

Both the bottom face 70*a* of the upper conveying passage 70 and the bottom face 68*a* of the lower conveying passage 68 extend in a nearly horizontal direction, and the bottom face 70*a* of the upper conveying passage 70 is positioned above the bottom face 68*a* of the lower conveying passage 68. In the side wall (that is, the partition wall 76) on the downstream side of the upper conveying passage 70 and on the side opposed to the lower conveying passage 68, the upper portion of the side wall is cut out and the opening section 65 is formed, whereby the lower wall section 61 is provided, as shown in FIG. 5.

The arrow 61*a* in FIG. 7A indicates the flow of the developer-tank-contained developer 3 overflowing from the opening section 65, and the obliquely upward arrow 69*a* in FIG. 7B indicates the obliquely upward flow of the developer-tank-contained developer 3 that is conveyed along the second communicating passage 69. In FIG. 7C, the arrow branched leftward on the downstream discharge side of the upper conveying passage 70 indicates the flow of the developer-tank-contained developer 3 that is conveyed toward the developer discharging section 79 described later, and the arrow branched downward on the discharge side of the developing device 34 indicates the flow of the developer-tank-contained developer 3 overflowing from the upper end section of the lower wall section 61. Hence, as shown in FIG. 7C, part of the developer-tank-contained developer 3 overflows downward from the opening section 65 (circulating flow outlet 63) by virtue of the conveying force of the second screw 74 (upper stirring member) and the gravitational force applied to the developer-tank-contained developer. Furthermore, the overflowed developer-tank-contained developer 3 is conveyed in the lower conveying passage 68 in a nearly horizontal direction, conveyed obliquely upward in the second communicating passage 69, and conveyed in the upper conveying passage 70 in a nearly horizontal direction; and the other part of the developer-tank-contained developer 3 is conveyed toward the developer discharging section 79.

Excessive discharge of the developer-tank-contained developer 3 to the developer discharging section 79 can be restricted using the opening section 65 provided in the side wall (that is, the partition wall 76) of the upper conveying passage 70 even when the developing device 34 is tilted such that the discharge side thereof is positioned low. Furthermore, since the second screw 74 (upper stirring member) is configured so as to be large, the force for conveying the developer-tank-contained developer 3 is increased, and the developer-tank-contained developer 3 can be pushed up and conveyed easily from the lower conveying passage 68 to the upper conveying passage 70 via the second communicating passage 69.

Figure 4:
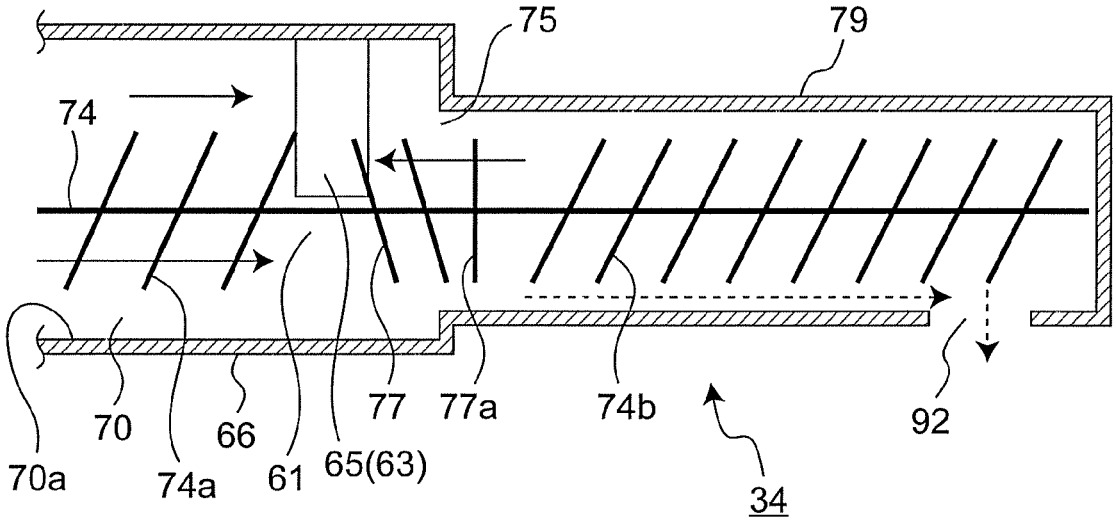
FIG. 4 is a schematic sectional view showing part of the developing device of the image forming apparatus shown in FIG. 1 as seen from the side.

The first screw 72 and the second screw 74 are each a spiral screw in which a spiral vane with a predetermined pitch is secured to a shaft. FIG. 4 is a schematic sectional view showing the developer discharging section 79 and its periphery, that is, part of the developing device 34, as seen from the side and corresponding to the right end section shown in FIG. 2. As shown in FIG. 4, the second screw 74 extends rightward in the figure and further extends above the recovery port 92.

The second screw 74 has a conveying forward screw section 74*a* extending to the upper conveying passage 70 and a discharging forward screw section 74*b* extending to the developer discharging section 79 positioned at the downstream side end section (the right end section in FIG. 2) in the conveying direction. The conveying forward screw section 74*a* conveys the developer-tank-contained developer existing inside the developer tank 66 to the developer discharging section 79. The discharging forward screw section 74*b* conveys the developer existing inside the developer discharging section 79 to the recovery port 92.

In addition, at each of the positions corresponding to the opening section 65 (circulating flow outlet 63) and to the downstream side end section of the lower conveying passage 68, the second screw 74 has a reverse screw section 77 in which the spiral direction of the spiral screw is opposite to that at the other section. A stopping member 77*a* is provided on the side of the developer discharging section 79 of the reverse screw section 77. The stopping member 77*a* is a nearly disc-shaped member extending in the direction orthogonal to the rotation shaft of the second screw 74 and has an action of restricting the rising of the developer-tank-contained developer 3 formed using the reverse screw section 77 from moving to the side of the developer discharging section 79.

When the second screw 74 rotates, a reverse flow for moving the developer-tank-contained developer 3 from the developer discharging section 79 to the upper conveying passage 70 is generated using the reverse screw section 77 as indicated by the leftward arrow in FIG. 4. As a result, when the second screw 74 rotates, the level of the developer-tank-contained developer 3 at the downstream side end section (the right end section) in the conveying direction of the second screw 74 becomes higher than that at the other section. In other words, a rising of the developer-tank-contained developer 3 is formed at the downstream side end section (the right end section) in the conveying direction of the upper conveying passage 70, that is, the reverse screw section 77. Furthermore, the stopping member 77*a* restricts the rising of the developer-tank-contained developer 3 from moving to the side of the developer discharging section 79.

Since the developing device 34 employs the so-called trickle system, the developing device has an excessive flow outlet 75 for allowing an excessive amount of the developer-tank-contained developer 3 to flow out. In other words, the outlet 75 is provided as the excessive flow cutout 75 that is formed by partially cutting out the upper portion of the side wall located at the downstream side end section (the right end section) in the conveying direction of the upper conveying passage 70. The excessive flow outlet 75 is provided on the downstream side (that is, on the side of the developer discharging section 79) from the lower wall section 61. Furthermore, the excessive flow outlet 75 is positioned above the opening section 65 (circulating flow outlet 63). In a usual state, the developer being conveyed using the second screw 74 is dammed using the reverse screw section 77 and the stopping member 77*a* and conveyed from the upper conveying passage 70 to the lower conveying passage 68 via the opening section 65 (circulating flow outlet 63) as indicated by the solid-line arrows shown in FIGS. 2 and 4. When the developer-tank-contained developer 3 increases inside the developer tank and the developer level inside the developer tank rises, the developer-tank-contained developer 3 climbs over the excessive flow outlet 75 provided at the upper portion of the side wall against the damming action of the reverse screw section 77 and the stopping member 77*a* and overflows to the developer discharging section 79 adjacent thereto. The excessive amount of the developer-tank-contained developer 3 overflowed to the developer discharging section 79 is conveyed to the recovery port 92 in the directions indicated by the broken-line arrows shown in FIG. 14 and recovered (dumped) into the developer recovery tank 90 via the recovery port 92.

As shown in FIG. 2, in the developer stirring and conveying chamber 67, a toner concentration detecting sensor 78 for detecting the toner concentration inside the developer stirring and conveying chamber 67 is provided. The toner concentration detecting sensor 78 detects the permeability of the developer-tank-contained developer 3 being conveyed inside the developer stirring and conveying chamber 67 on the basis of the change in the inductance of a coil, for example. The ratio of the toner in the developer-tank-contained developer 3 is obtained on the basis of the permeability detected using the toner concentration detecting sensor 78. For example, when the amount of the carrier contained in the developer-tank-contained developer 3 is small, it is detected that the ratio of the toner is high. On the other hand, when the amount of the carrier contained in the developer-tank-contained developer 3 is large, it is detected that the ratio of the toner is low. In addition, the voltage signal output from the toner concentration detecting sensor 78 is input to the controller 100, a required replenishing amount is calculated on the basis of the detection signal, the developer replenishing roller of the developer replenishing tank 80 is driven, and the predetermined amount of the replenishment developer 2 is replenished into the developer tank 66.

In the developing device 34, when the toner concentration of the circulating developer-tank-contained developer 3 lowers as the image formation operation proceeds, the replenishment developer 2 containing toner and a small amount of carrier is replenished from the developer replenishing tank 80. The replenishment developer 2 having been replenished is conveyed along the lower conveying passage 68 and the upper conveying passage 70 of the above-mentioned developer stirring and conveying chamber 67 while being mixed and stirred with the developer-tank-contained developer 3 already existing therein. Although the toner is basically consumed on the photosensitive member 12, the carrier is accumulated inside the developing device 34, and the charging performance of the carrier lowers gradually. Since a small amount of the carrier that is bulkier than the toner is contained in the replenishment developer 2, as the replenishment developer 2 is replenished, the amount of the developer-tank-contained developer 3 gradually increases inside the developing device 34. Then, the developer-tank-contained developer 3 having increased in volume circulates in the developer stirring and conveying chamber 67. An excessive amount of the developer-tank-contained developer 3 being unable to circulate in the developer stirring and conveying chamber 67 climbs over the reverse screw section 77 and flows out from the excessive flow outlet 75 provided at the downstream side end section (the right end section) in the conveying direction of the upper conveying passage 70 and is recovered in the developer recovery tank 90 via the recovery port 92.

The replenishing amount of the replenishment developer 2 is determined on the basis of the toner concentration of the developer-tank-contained developer 3 detected using the toner concentration detecting sensor 78, the image information (dot counter) at the time of image formation and the ratio of the carrier in the replenishment developer 2 inside the developer replenishing tank 80. The ratio of the carrier in the replenishment developer 2 inside the developer replenishing tank 80 is adjusted to the extent that the carrier inside the developing device 34 is suppressed from deteriorating and that the cost is not increased. As the toner replenishing operation proceeds, the carrier is supplied gradually.

Figure 3:
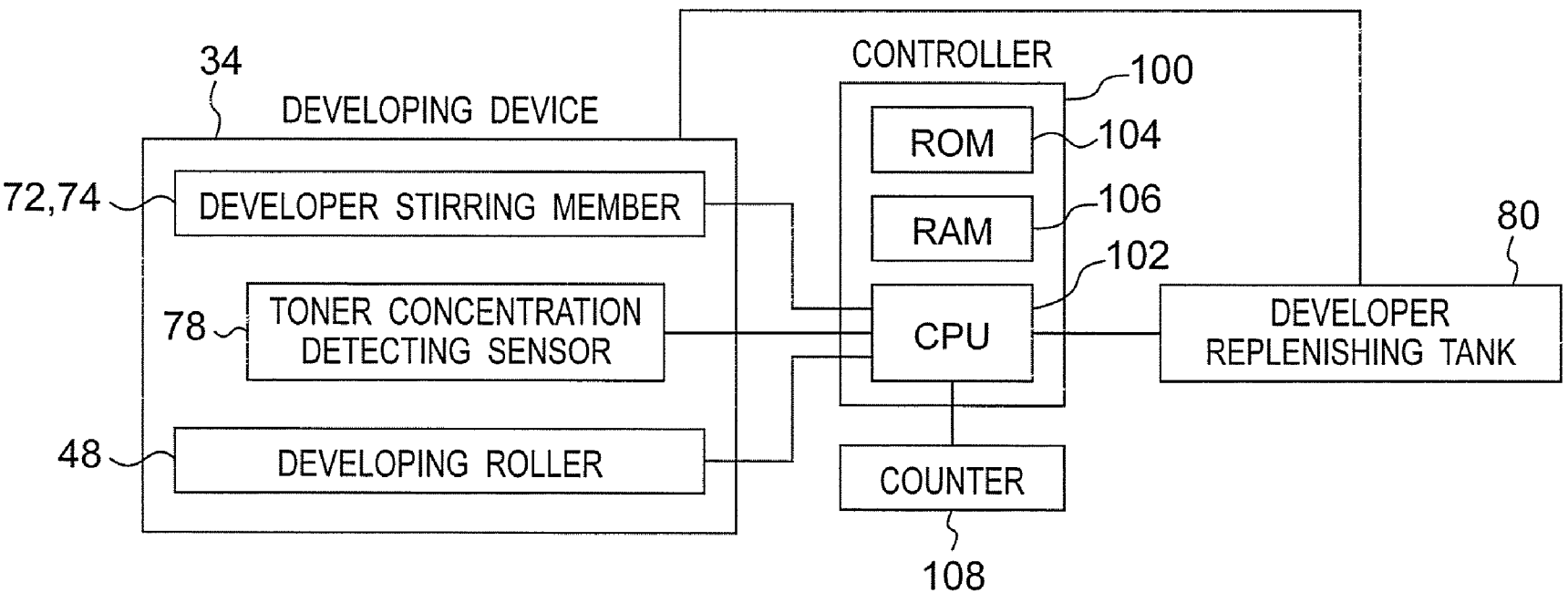
FIG. 3 is a block diagram of the developing device of the image forming apparatus shown in FIG. 2.

FIG. 3 is a control block diagram of the developing device 34 of the image forming apparatus 1.

The controller 100 serving as control unit comprises a CPU (central processing unit) 102, a ROM (read only memory) 104, a RAM (random access memory) 106, etc. The CPU 102 concentratedly controls various operations in the image forming apparatus 1 according to various processing programs and tables stored inside the ROM 104. In the ROM 104, for example, a toner concentration calculation table for carrying out calculation to convert the voltage detected using the toner concentration detecting sensor 78 into the toner concentration of the developer-tank-contained developer 3 and a developer replenishing table for calculating the amount of the developer to be replenished on the basis of the difference between the actual toner concentration of the developer-tank-contained developer 3 and the reference toner concentration are stored. The RAM 106 provides a work area in which various programs to be executed by the controller 100 and data for the programs are temporarily stored.

The developing device 34, the developer replenishing tank 80 and a counter 108 are connected to the controller 100. The operations of the developer stirring members 72 and 74, the toner concentration detecting sensor 78 and the developing roller 48 constituting the developing device 34 are controlled using the CPU 102 of the controller 100. In addition, the toner concentration of the developer-tank-contained developer 3 detected using the toner concentration detecting sensor 78, image information at the time of image formation, the ratio of the carrier in the replenishment developer 2 inside the developer replenishing tank 80, etc. are temporarily stored in the RAM 106.

[Developer]

The two-component developer contains toner and carrier for charging the toner. In the present invention, the known toner that has been used generally and conventionally can be used for the image forming apparatus 1. The particle diameter of the toner is, for example, approximately 3 to 15 μm. It is also possible to use toner containing a coloring agent in a binder resin, toner containing a charge control agent and a releasing agent, and toner holding additives on the surface.

The toner is produced using known methods, such as the grinding method, the emulsion polymerization method and the suspension polymerization method.

Examples of the binder resin being used for the toner include styrene resins (homopolymers or copolymers containing styrene or styrene substitutes), polyester resins, epoxy resins, polyvinyl chloride resins, phenol resins, polyethylene resins, polypropylene resins, polyurethane resins, silicone resins or any appropriate combinations of these resins, although not restricted to these. The softening temperature of the binder resin is preferably in the range of approximately 80 to 160° C., and the glass transition temperature thereof is preferably in the range of approximately 50 to 75° C.

As the coloring agent, it is possible to use known materials, such as carbon black, aniline black, activated charcoal, magnetite, benzine yellow, permanent yellow, naphthol yellow, phthalocyanine blue, fast sky blue, ultramarine blue, rose bengal and lake red. In general, the additive amount of the coloring agent is preferably 2 to 20 parts by weight per 100 parts by weight of the binder resin.

The materials conventionally known as charge control agents can be used as the charging control agent. More specifically, for the toner that is positively charged, it is possible to use materials, such as nigrosin dyes, quaternary ammonium salt compounds, triphenylmethane compounds, imidazole compounds and polyamine resins, as the charge control agent. For the toner that is negatively charged, it is possible to use materials, such as azo dyes containing metals such as Cr, Co, Al and Fe, salicylic acid metal compounds, alkyl salicylic acid metal compounds and calixarene compounds, as the charge control agent. It is desirable that the charge control agent is used in the ratio of 0.1 to 10 parts by weight per 100 parts by weight of the binder resin.

The materials conventionally known and used as releasing agents can be used as the releasing agent. As the material of the releasing agent, it is possible to use materials, such as polyethylene, polypropylene, carnauba wax, sasol wax or any appropriate combinations of these. It is desirable that the releasing agent is used in the ratio of 0.1 to 10 parts by weight per 100 parts by weight of the binder resin.

Furthermore, it may be possible to add a fluidizer for accelerating the fluidization of the developer. As the fluidizer, it is possible to use inorganic particles, such as silica, titanium oxide and aluminum oxide, and resin particles, such as acrylic resins, styrene resins, silicone resins and fluororesins. It is particularly desirable to use materials hydrophobized using a silane coupling agent, a titanium coupling agent, silicone oil, etc. It is desirable that the fluidizer is added in the ratio of 0.1 to 5 parts by weight per 100 parts by weight of the toner. It is desirable that the number average primary particle diameters of these additives are in the range of 9 to 100 nm.

As the carrier, the known carriers used conventionally and generally can be used. Either the binder-type carrier or the coated-type carrier may be used. It is desirable that the diameter of the carrier particles is in the range of approximately 15 to 100 μm, although not restricted to this range.

The binder-type carrier is that obtained by dispersing magnetic particles in a binder resin and it is possible to use carrier having positively or negatively charged particles or a coating layer on its surface. The charging characteristics, such as polarity, of the binder-type carrier can be controlled depending on the material of the binder resin, electrostatic charging particles and the kind of the surface coating layer.

Examples of the binder resin being used for the binder-type carrier include thermoplastic resins, such as vinyl resins typified by polystyrene resins, polyester resins, nylon resins and polyolefin resins, and thermosetting resins, such as phenol resins.

As the magnetic particles of the binder-type carrier, it is possible to use spinel ferrites, such as magnetite and gamma ferric oxide; spinel ferrites containing one or more kinds of nonferrous metals (such as Mn, Ni, Mg and Cu); magnetoplumbite ferrites, such as barium ferrite; and iron or alloy particles having oxide layers on the surfaces. The shape of the carrier may be particulate, spherical or needle-like. In particular, when high magnetization is required, it is desirable to use iron-based ferromagnetic particles. In consideration of chemical stability, it is desirable to use ferromagnetic particles of spinel ferrites, such as magnetite and gamma ferric oxide, or magnetoplumbite ferrites, such as barium ferrite. It is possible to obtain magnetic resin carrier having the desired magnetization by appropriately selecting the kind and content of the ferromagnetic particles. It is appropriate to add 50 to 90 wt % of the magnetic particles to the magnetic resin carrier.

As the surface coating material of the binder-type carrier, it is possible to use silicone resins, acrylic resins, epoxy resins, fluororesins, etc. The charging capability of the carrier can be enhanced by coating the surface of the carrier with this kind of resin and by thermosetting the resin.

The fixation of electrostatic charging particles or electrically conductive particles to the surface of the binder-type carrier is carried out according to, for example, a method in which the magnetic resin carrier is uniformly mixed with the particles, the particles are attached to the surface of the magnetic resin carrier, and then mechanical and thermal impact forces are applied to the particles to put the particles into the magnetic resin carrier. In this case, the particles are not completely embedded into the magnetic resin carrier but fixed such that parts thereof protrude from the surface of the magnetic resin carrier. As the electrostatic charging particles, organic or inorganic insulating materials are used. More specifically, as organic insulating materials, organic insulating particles, such as polystyrene, styrene copolymers, acrylic resins, various acrylic copolymers, nylon, polyethylene, polypropylene, fluororesins and cross-linked materials of these are available. The charging capability and the charging polarity thereof can be adjusted so as to be suited for the material of the electrostatic charging particles, polymerization catalyst, surface treatment, etc. As the inorganic insulating material, negatively charged inorganic particles, such as silica and titanium dioxide, and positively charged inorganic particles, such as strontium titanate and alumina, are used.

The coated-type carrier is carrier obtained by coating carrier core particles made of a magnetic substance with a resin, and electrostatic charging particles charged positively or negatively can be fixed to the surface of the carrier, as in the case of the binder-type carrier. The charging characteristics, such as polarity, of the coated-type carrier can be adjusted by selecting the kind of the surface coating layer and the electrostatic charging particles. As the coating resin, it is possible to use resins similar to the binder resins for the binder-type carrier.

The mixture ratio of the toner and the carrier of the developer-tank-contained developer 3 is adjusted such that a desired toner charging amount is obtained. The ratio of the toner in the developer-tank-contained developer 3 is preferably 3 to 20 wt % and further preferably 4 to 15 wt % with respect to the total amount of the toner and the carrier. In addition, the replenishment developer 2 stored in the developer replenishing tank 80 contains toner and a small amount of carrier, and the ratio of the carrier in the replenishment developer 2 is preferably 1 to 50 wt % and further preferably 5 to 30 wt %.

The operation of the developing device 34 configured as described above will be described.

At the time of image formation, the sleeve 48*b* of the developing roller 48 is rotated in the direction indicated by the arrow (counterclockwise) on the basis of the driving of the motor (not shown). By the rotation of the first screw 72 and the rotation of the second screw 74, the developer-tank-contained developer 3 existing in the developer stirring and conveying chamber 67 is stirred while being circulated and conveyed through the upper conveying passage 70, the opening section 65 (circulating flow outlet 63), the lower conveying passage 68 and the second communicating passage 69. As a result, the toner and the carrier contained in the developer make friction contact and are charged to have polarities opposite to each other. In this embodiment, it is assumed that the carrier is positively charged and that the toner is negatively charged. However, the charging characteristics of the toner and the carrier being used for the present invention are not limited to these combinations. The external size of the carrier is considerably larger than that of the toner. For this reason, the negatively charged toner is attached around the circumference of the positively charged carrier mainly on the basis of the electric attraction force exerted therebetween.

The developer-tank-contained developer 3 charged as described above is supplied to the developing roller 48 in the process of being conveyed along the upper conveying passage 70 using the second screw 74. The developer is held on the surface of the sleeve 48*b* by the magnetic force of the magnet 48*a* inside the developing roller 48 and moved while being rotated counterclockwise together with the sleeve 48*b*, the throughput thereof is regulated using the regulating plate 62 disposed so as to be opposed to the developing roller 48, and then the developer is conveyed to the developing area opposed to the photosensitive member 12. Furthermore, in the developing area, chains of particles (magnetic brush) are formed by the magnetic force of the main magnet pole N1 of the magnet 48*a*. In the developing area, by the force of the electric field (electric field of AC superimposed on DC) that is formed between the electrostatic latent image on the photosensitive member 12 and the developing roller 48 to which a developing bias is applied and exerted to the toner, the toner is moved to the electrostatic latent image on the photosensitive member 12, and the electrostatic latent image is developed into a visible image. The developer, the toner of which is consumed in the developing area, is conveyed toward the developer tank 66, detached from the surface of the developing roller 48 by the repulsive magnetic field between the poles N3 and N2 of the magnet 48*a* disposed so as to be opposed to the upper conveying passage 70 of the developer tank 66, and then recovered into the developer tank 66. The recovered developer is mixed with the developer-tank-contained developer 3 that is being conveyed to the upper conveying passage 70.

When the toner contained in the developer-tank-contained developer 3 is consumed by the image formation described above, it is desirable that the amount of the toner corresponding to the consumed amount is replenished to the developer-tank-contained developer 3. For this purpose, the developing device 34 is equipped with the toner concentration detecting sensor 78 for measuring the ratio of the toner in the developer-tank-contained developer 3 existing in the developer stirring and conveying chamber 67. Furthermore, the developer replenishing tank 80 is provided above the lower conveying passage 68.

In the above-mentioned developing device 34, since the developer level in the lower conveying passage 68 is positioned below that in the opening section 65 as described earlier, the overflow space is formed above the developer level in the lower conveying passage 68. Hence, even if the image forming apparatus 1 is placed slightly tilted (tilt disposition) when placed on a desk or the like, no developer-tank-contained developer 3 hindering the discharge of the developer-tank-contained developer 3 exists at the tip of the opening section 65; hence, the developer-tank-contained developer 3 increased near the opening section 65 by the tilt disposition is discharged efficiently from the opening section 65. Therefore, it is possible to restrict excessive discharge of the developer to the developer discharging section 79. Furthermore, since the reverse screw section 77 acting to prevent the developer-tank-contained developer 3 from moving to the side of the discharging mechanism is provided on the downstream side of the upper conveying passage 70, the developer-tank-contained developer 3 having increased by the tilt disposition is stopped but moves positively toward the opening section 65.

Next, the characteristic sections of the developing device 34 and the operations thereof according to a second embodiment of the present invention will be described referring to FIGS. 8A, 8B, and 8C. However, since the configurations of the sections other than those of the characteristic sections according to the second embodiment are the same as those according to the above-mentioned first embodiment, the description regarding the configurations of the sections other than those of the characteristic sections is omitted.

Figure 8A:
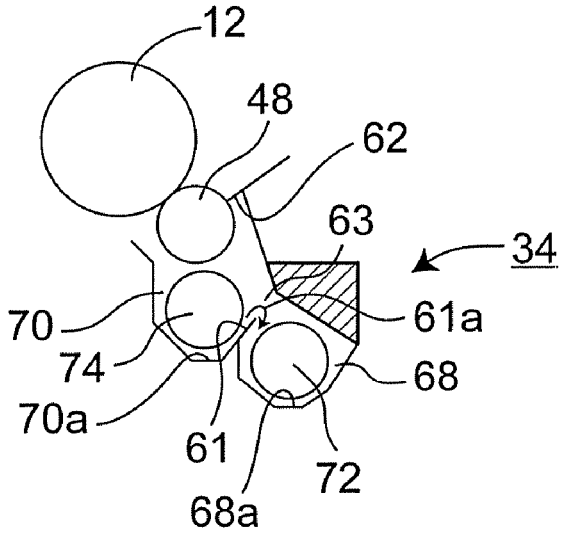
FIG. 8A is a schematic side view showing the developing device as seen from the side of a developer discharging section according to a second embodiment of the present invention.
Figure 8B:
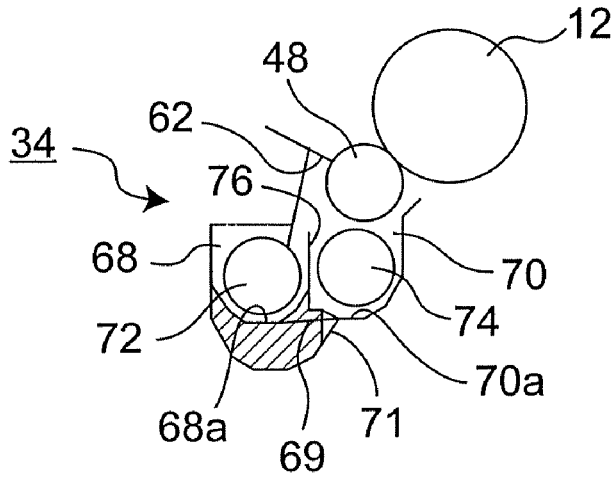
FIG. 8B is a schematic side view showing the developing device as seen from the opposite side of the developer discharging section according to the second embodiment of the present invention.
Figure 8C:
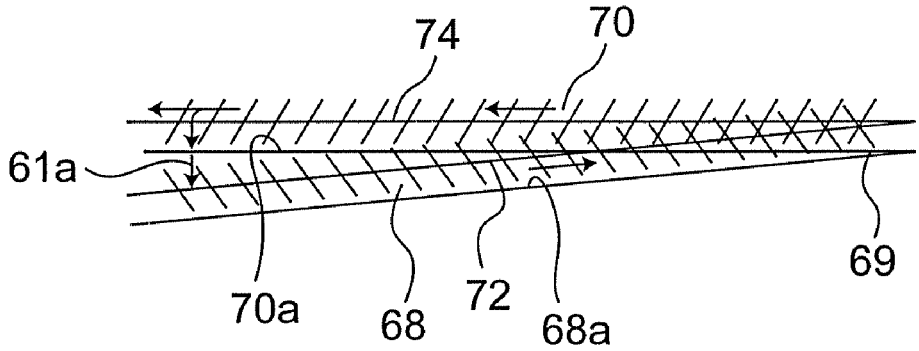
FIG. 8C is a schematic view showing the developing device as seen from the side according to the second embodiment of the present invention.

FIG. 8A is a schematic side view showing the developing device 34 as seen from the side of the developer discharging section 79 according to the second embodiment of the present invention, FIG. 8B is a schematic side view showing the developing device 34 as seen from the opposite side of the developer discharging section 79 according to the second embodiment of the present invention, and FIG. 8C is a schematic view showing the developing device 34 as seen from the side according to the second embodiment of the present invention.

The developing device 34 according to the second embodiment shown in FIGS. 8A, 8B, and 8C is a variation example of the above-mentioned first embodiment and is configured such that the distance between the bottom face 70*a* of the upper conveying passage 70 and the bottom face 68*a* of the lower conveying passage 68 is larger on the side of the lower wall section 61 and is smaller on the side of the second communicating passage 69, and such that the outside diameter of the second screw 74 (upper stirring member) and the outside diameter of the first screw 72 (lower stirring member) are substantially identical. In the example shown in FIGS. 8A, 8B, and 8C, both the downstream side portion of the bottom face 68*a* of the lower conveying passage 68 and the upstream side portion of the bottom face 70*a* of the upper conveying passage 70, being connected to each other using the second communicating passage 69, extend on nearly identical horizontal planes, whereby the bottom face 68*a* of the lower conveying passage 68 is continuously connected to the bottom face 70*a* of the upper conveying passage 70; however, the downstream side portion of the bottom face 68*a* and the upstream side portion of the bottom face 70*a*, being connected to the second communicating passage 69, are not necessarily required to extend on the nearly identical horizontal planes; the downstream side portion of the bottom face 68*a* may be configured so as to be higher than the upstream side portion of the bottom face 70*a*.

The bottom face 70*a* of the upper conveying passage 70 extending in a nearly horizontal direction is positioned at a level nearly as high as or higher than the bottom face 68*a* of the lower conveying passage 68. In the bottom face 68*a* of the lower conveying passage 68, the discharge side thereof, that is, the side on the lower wall section 61, is disposed low, and the side on the opposite side of the discharge side, that is, the side of the second communicating passage 69, is disposed high. Hence, the bottom face 68*a* of the lower conveying passage 68 is tilted obliquely upward with respect to the horizontal plane as seen from the side of the developer discharging section 79.

The arrow 61*a* in FIG. 8A indicates the downward flow of the developer-tank-contained developer 3 overflowing from the opening section 65 (circulating flow outlet 63). In FIG. 8C, the arrow branched leftward on the discharge side of the developing device 34 indicates the flow of the developer-tank-contained developer 3 that is conveyed toward the developer discharging section 79, and the arrow branched downward on the discharge side of the developing device 34 indicates the flow of the developer-tank-contained developer 3 overflowing from the opening section 65 (circulating flow outlet 63). Hence, as shown in FIG. 8C, part of the developer-tank-contained developer 3 overflows downward from the opening section 65 (circulating flow outlet 63) by virtue of the conveying force of the second screw 74 (upper stirring member). Furthermore, the overflowed developer-tank-contained developer 3 is conveyed obliquely upward in the lower conveying passage 68, conveyed in the second communicating passage 69 in a nearly horizontal direction, and conveyed in the upper conveying passage 70 in a nearly horizontal direction; and the other part of the developer-tank-contained developer 3 is conveyed toward the developer discharging section 79.

Excessive discharge of the developer-tank-contained developer 3 to the developer discharging section 79 can be restricted using the lower wall section 61 provided in the side wall (that is, the partition wall 76) of the upper conveying passage 70 even when the developing device 34 is tilted such that the discharge side thereof is positioned low.

Since the outside diameter of the second screw 74 (upper stirring member) and the outside diameter of the first screw 72 (lower stirring member) are substantially identical, the second screw 74 (upper stirring member) and the first screw 72 (lower stirring member) can be used commonly, whereby parts control can be facilitated and cost can be reduced. In addition, since the screws 72 and 74 being compact in size are used, space saving can be achieved for the developing device 34. Furthermore, since a space is formed between the lower side of the bottom face 70*a* of the upper conveying passage 70 and the side face of the lower conveying passage 68 although the space is slightly smaller than that in the developing device 34 according to the first embodiment, other components can be disposed and installed in this space. Moreover, since the downstream side portion of the bottom face 68*a* is positioned at a level as high as or higher than the upstream side portion of the bottom face 70*a*, it is not necessary to push up the developer-tank-contained developer 3 along the second communicating passage 69, whereby the rotation drive torque applied when the first screw 72 (lower stirring member) is driven and rotated is reduced.

Next, the characteristic sections of the developing device 34 and the operations thereof according to a third embodiment of the present invention will be described referring to FIGS. 9A, 9B, and 9C. However, since the configurations of the sections other than those of the characteristic sections according to the third embodiment are the same as those according to the above-mentioned first embodiment, the description regarding the configurations of the sections other than those of the characteristic sections is omitted.

Figure 9A:
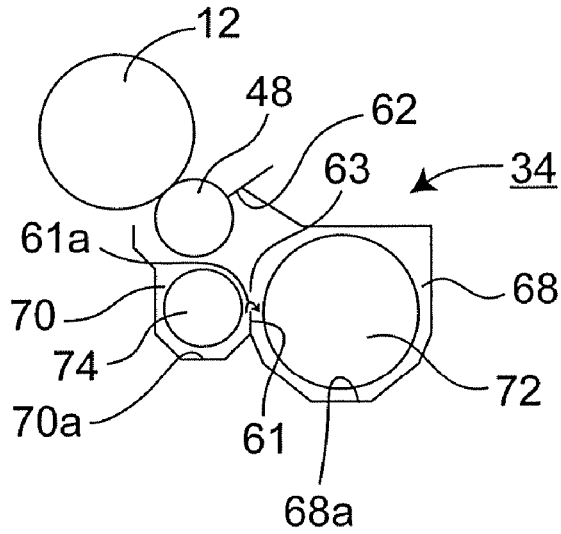
FIG. 9A is a schematic side view showing the developing device as seen from the side of a developer discharging section according to a third embodiment of the present invention.
Figure 9B:
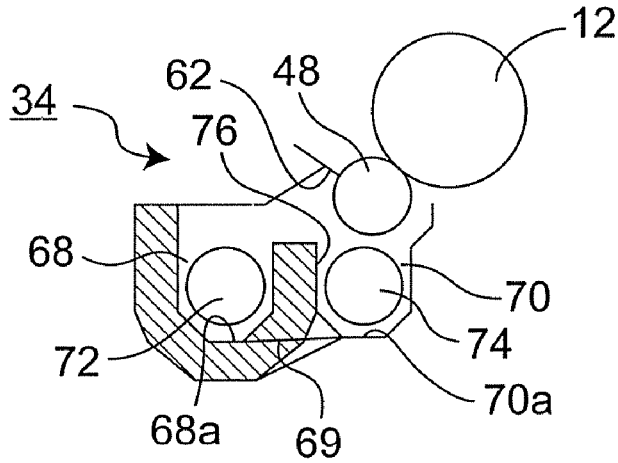
FIG. 9B is a schematic side view showing the developing device as seen from the opposite side of the developer discharging section according to the third embodiment of the present invention.
Figure 9C:
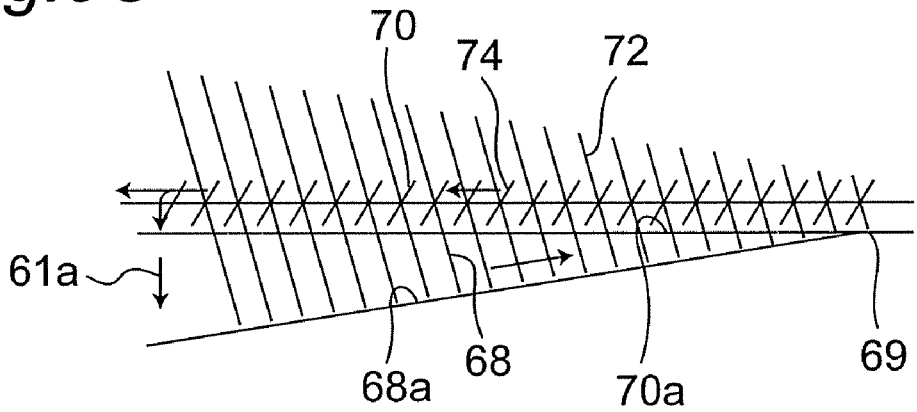
FIG. 9C is a schematic view showing the developing device as seen from the side according to the third embodiment of the present invention.

FIG. 9A is a schematic side view showing the developing device 34 as seen from the side of the developer discharging section 79 according to a third embodiment of the present invention, FIG. 9B is a schematic side view showing the developing device 34 as seen from the opposite side of the developer discharging section 79 according to a third embodiment of the present invention, and FIG. 9C is a schematic view showing the developing device 34 as seen from the side according to a third embodiment of the present invention.

The developing device 34 according to the third embodiment shown in FIGS. 9A, 9B, and 9C is a variation example of the above-mentioned second embodiment and is configured such that the bottom face 70*a* of the upper conveying passage 70 extends on a nearly horizontal plane, such that the bottom face 68*a* of the lower conveying passage 68 is tilted obliquely upward as seen from the developer discharging section 79, such that the outside diameter of the first screw 72 (lower stirring member) is larger than the outside diameter of the second screw 74 (upper stirring member), and such that the outside diameter of the first screw 72 (lower stirring member) gradually becomes smaller toward the second communicating passage 69, that is, the outside diameter is reduced.

In the example shown in FIGS. 9A, 9B, and 9C, the rotation shaft of the first screw 72 (lower stirring member) and the rotation shaft of the second screw 74 (upper stirring member) extend on nearly identical horizontal planes; however, the two rotation shafts are not necessarily required to extend on the nearly identical horizontal planes. Furthermore, the downstream side portion of the bottom face 68*a* of the lower conveying passage 68 and the upstream side portion of the bottom face 70*a* of the upper conveying passage 70, being connected to each other using the second communicating passage 69, extend on nearly identical horizontal planes; however, the downstream side portion of the bottom face 68*a* and the upstream side portion of the bottom face 70*a*, being connected to the second communicating passage 69, are not necessarily required to extend on the nearly identical horizontal planes; the downstream side portion of the bottom face 68*a* may be configured so as to be higher than the upstream side portion of the bottom face 70*a*.

The bottom face 70*a* of the upper conveying passage 70 extending in a nearly horizontal direction is positioned at a level nearly as high as or higher than the bottom face 68*a* of the lower conveying passage 68. In the bottom face 68*a* of the lower conveying passage 68, the discharge side thereof, that is, the side of the lower wall section 61, is disposed low, and the side on the opposite side of the discharge side, that is, the side on the second communicating passage 68, is disposed high. Hence, the bottom face 68*a* of the lower conveying passage 68 is tilted obliquely upward with respect to the horizontal plane as seen from the side of the developer discharging section 79.

The arrow 61*a* in FIG. 9A indicates the downward flow of the developer-tank-contained developer 3 overflowing from the opening section 65 (circulating flow outlet 63). In FIG. 9C, the arrow branched leftward on the discharge side of the developing device 34 indicates the flow of the developer-tank-contained developer 3 that is conveyed toward the developer discharging section 79, and the arrow branched downward on the discharge side of the developing device 34 indicates the flow of the developer-tank-contained developer 3 overflowing from the opening section 65 (circulating flow outlet 63). Hence, as shown in FIG. 9C, part of the developer-tank-contained developer 3 overflows downward from the opening section 65 (circulating flow outlet 63) by virtue of the conveying force of the second screw 74 (upper stirring member). Furthermore, the overflowed developer-tank-contained developer 3 is conveyed obliquely upward in the lower conveying passage 68, conveyed in the second communicating passage 69 in a nearly horizontal direction, and conveyed in the upper conveying passage 70 in a nearly horizontal direction; and the other part of the developer-tank-contained developer 3 is conveyed toward the developer discharging section 79.

Excessive discharge of the developer-tank-contained developer 3 to the developer discharging section 79 can be restricted using the lower wall section 61 provided in the side wall (that is, the partition wall 76) of the upper conveying passage 70 even when the developing device 34 is tilted such that the discharge side thereof is positioned low. Furthermore, since the downstream side portion of the bottom face 68*a* is positioned at a level as high as or higher than the upstream side portion of the bottom face 70*a*, it is not necessary to push up the developer-tank-contained developer 3 along the second communicating passage 69, whereby the rotation drive torque applied when the first screw 72 (lower stirring member) is driven and rotated is reduced.

Next, the characteristic sections of the developing device 34 and the operations thereof according to a fourth embodiment of the present invention will be described referring to FIGS. 10A, 10B, and 10C. However, since the configurations of the sections other than those of the characteristic sections according to the fourth embodiment are the same as those according to the above-mentioned third embodiment, the description regarding the configurations of the sections other than those of the characteristic sections is omitted.

Figure 10A:
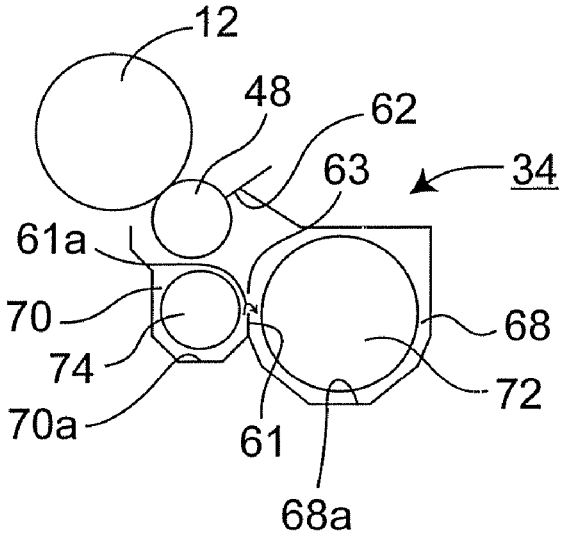
FIG. 10A is a schematic side view showing the developing device as seen from the side of a developer discharging section according to a fourth embodiment of the present invention.
Figure 10B:
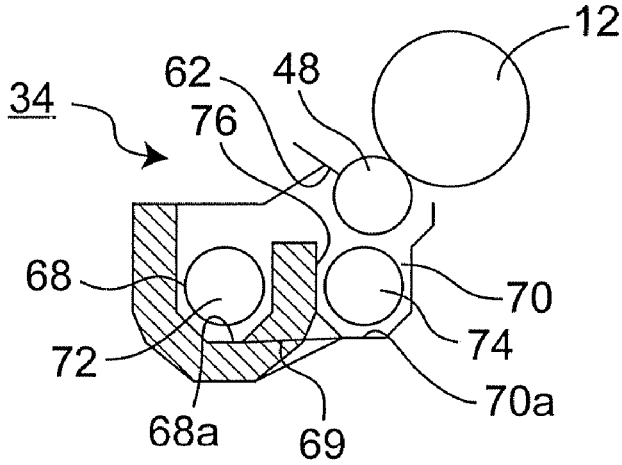
FIG. 10B is a schematic side view showing the developing device as seen from the opposite side of the developer discharging section according to the fourth embodiment of the present invention.
Figure 10C:
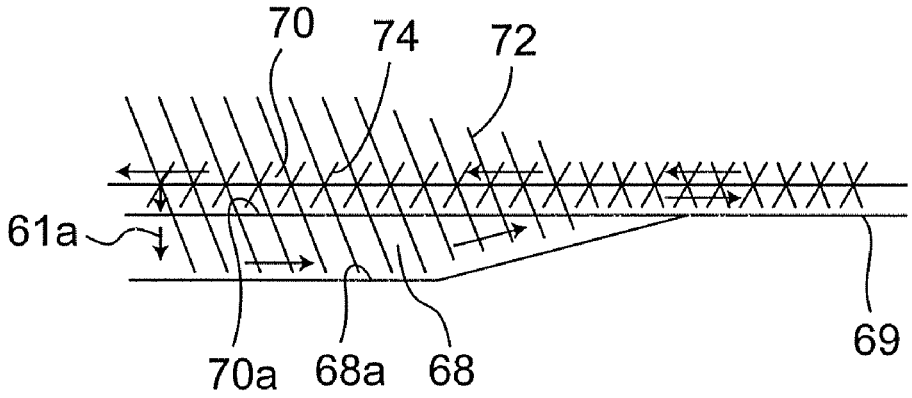
FIG. 10C is a schematic view showing the developing device as seen from the side according to the fourth embodiment of the present invention.

FIG. 10A is a schematic side view showing the developing device 34 as seen from the side of the developer discharging section 79 according to the fourth embodiment of the present invention, FIG. 10B is a schematic side view showing the developing device 34 as seen from the opposite side of the developer discharging section 79 according to the fourth embodiment of the present invention, and FIG. 10C is a schematic view showing the developing device 34 as seen from the side according to the fourth embodiment of the present invention.

The developing device 34 according to the fourth embodiment shown in FIGS. 10A, 10B, and 10C is a variation example of the above-mentioned third embodiment and is configured such that the bottom face 70*a* of the upper conveying passage 70 extends on a nearly horizontal plane, such that the bottom face 68*a* of the lower conveying passage 68 is tilted obliquely upward as seen from the developer discharging section 79, and such that the outside diameter of the first screw 72 (lower stirring member) is larger than the outside diameter of the second screw 74 (upper stirring member) at the portion on the side of the lower wall section 61, is nearly identical with the outside diameter of the second screw 74 (upper stirring member) at the portion on the side of the second communicating passage 69 and gradually becomes smaller in the intermediate portion.

In the example shown in FIGS. 10A, 10B, and 10C, the rotation shaft of the first screw 72 (lower stirring member) and the rotation shaft of the second screw 74 (upper stirring member) extend on nearly identical horizontal planes; however, the two rotation shafts are not necessarily required to extend on the nearly identical horizontal planes. Furthermore, the downstream side portion of the bottom face 68*a* of the lower conveying passage 68 and the upstream side portion of the bottom face 70*a* of the upper conveying passage 70, being connected to each other using the second communicating passage 69, extend on nearly identical horizontal planes; however, the downstream side portion of the bottom face 68*a* and the upstream side portion of the bottom face 70*a*, being connected to the second communicating passage 69, are not necessarily required to extend on the nearly identical horizontal planes; the downstream side portion of the bottom face 68*a* may be configured so as to be higher than the upstream side portion of the bottom face 70*a*.

The bottom face 70*a* of the upper conveying passage 70 extending in a nearly horizontal direction is positioned at a level nearly as high as or higher than the bottom face 68*a* of the lower conveying passage 68. In the bottom face 68*a* of the lower conveying passage 68, the discharge side thereof, that is, the portion on the side of the lower wall section 61, extends in a nearly horizontal direction and is disposed below the other portions. The portion on the opposite side of the discharge side, that is, the portion on the side of the second communicating passage 68, extends in a nearly horizontal direction and is disposed above the other portions. The intermediate portion of the bottom face 68*a* of the developer discharging section 79 extends obliquely upward. Hence, the bottom face 68*a* of the lower conveying passage 68 has a portion extending in a nearly horizontal direction, a portion tilted obliquely upward with respect to the horizontal plane and a portion extending in a nearly horizontal direction as seen from the side of the developer discharging section 79.

The arrow 61*a* in FIG. 10A indicates the downward flow of the developer-tank-contained developer 3 overflowing from the opening section 65 (circulating flow outlet 63). In FIG. 10C, the arrow branched leftward on the discharge side of the developing device 34 indicates the flow of the developer-tank-contained developer 3 that is conveyed toward the developer discharging section 79, and the arrow branched downward on the discharge side of the developing device 34 indicates the flow of the developer-tank-contained developer 3 overflowing from the opening section 65 (circulating flow outlet 63). Hence, as shown in FIG. 10C, part of the developer-tank-contained developer 3 overflows downward from the opening section 65 (circulating flow outlet 63) by virtue of the conveying force of the second screw 74 (upper stirring member). Furthermore, the overflowed developer-tank-contained developer 3 is sequentially conveyed in a nearly horizontal direction, obliquely upward and in a nearly horizontal direction in the lower conveying passage 68, conveyed in the second communicating passage 69 in a nearly horizontal direction, and conveyed in the upper conveying passage 70 in a nearly horizontal direction; and the other part of the developer-tank-contained developer 3 is conveyed toward the developer discharging section 79.

Excessive discharge of the developer-tank-contained developer 3 to the developer discharging section 79 can be restricted using the lower wall section 61 provided in the side wall (that is, the partition wall 76) of the upper conveying passage 70 even when the developing device 34 is tilted such that the discharge side thereof is positioned low. Furthermore, since the downstream side portion of the bottom face 68*a* is positioned at a level as high as or higher than the upstream side portion of the bottom face 70*a*, it is not necessary to push up the developer-tank-contained developer 3 along the second communicating passage 69, whereby the rotation drive torque applied when the first screw 72 (lower stirring member) is driven and rotated is reduced.

Next, the characteristic sections of the developing device 34 and the operations thereof according to a fifth embodiment of the present invention will be described referring to FIG. 11. However, since the configurations of the sections other than those of the characteristic sections according to the fifth embodiment are the same as those according to the above-mentioned respective embodiments, the description regarding the configurations of the sections other than those of the characteristic sections is omitted.

Figure 11:
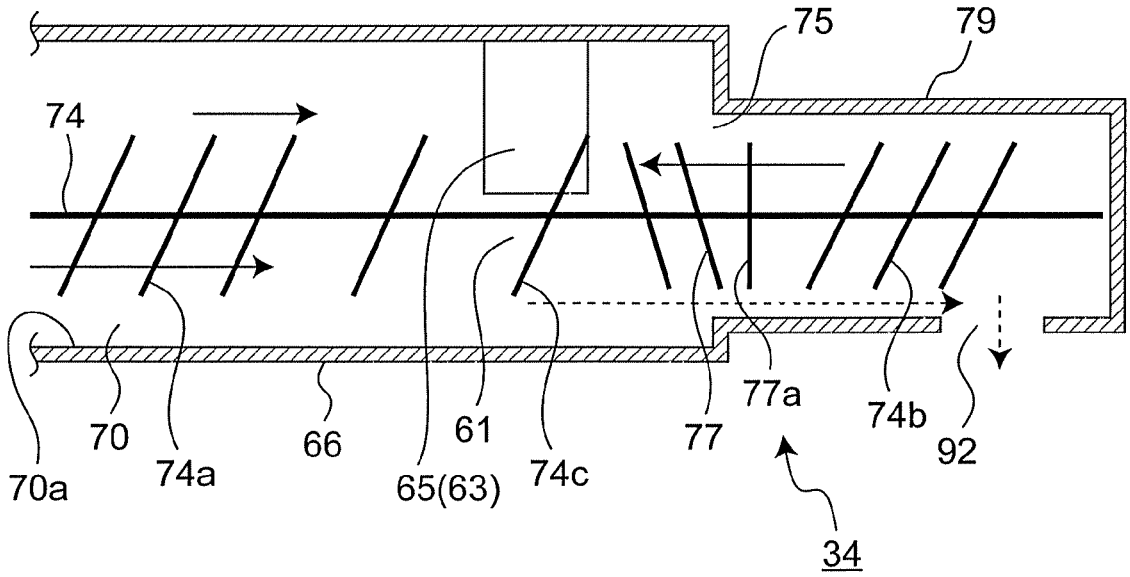
FIG. 11 is a view schematically illustrating the characteristic sections of a developing device according to a fifth embodiment of the present invention.

FIG. 11 is a schematic sectional view showing part of the developing device 34 according to the fifth embodiment of the present invention as seen from the side.

When the developer-tank-contained developer 3 is conveyed in a consolidated state in the upper conveying passage 70, the fluidity of the developer-tank-contained developer 3 lowers, and the developer-tank-contained developer 3 tends to easily advance in the straight-ahead direction in which the second screw 74 (upper stirring member) of the upper conveying passage 70 extends, that is, in the direction toward the developer discharging section 79, but tends to hardly advance to the lower wall section 61 that is disposed so as to be nearly orthogonal to the upper conveying passage 70. In other words, if the fluidity of the developer-tank-contained developer 3 is low, the developer-tank-contained developer 3 is conveyed toward the developer discharging section 79 rather than toward the opening section 65 (circulating flow outlet 63).

In order that the developer-tank-contained developer 3 is easily conveyed to the opening section 65 (circulating flow outlet 63), it is desired to raise the fluidity of the developer-tank-contained developer 3. For this purpose, it is desirable that the pitch at the portion of the second screw 74 (upper stirring member) close to the developer discharging section 79 is larger than that at the other portions of the second screw 74 (upper stirring member). As the pitch of the screw is larger, the conveying speed of the developer-tank-contained developer 3 becomes higher, and an air gap is apt to be formed easily between the developer-tank-contained developer 3 and the developer-tank-contained developer 3 adjacent thereto. The fact that the air gap is formed between the developer-tank-contained developer 3 and the developer-tank-contained developer 3 adjacent thereto means that ambient air is apt to be held easily in the developer-tank-contained developer 3. Therefore, as the pitch of the screw is larger, the fluidity of the developer-tank-contained developer 3 becomes higher.

Hence, as shown in FIG. 11, the pitch in the pitch-enlarged screw section 74*c* on the downstream side of the second screw 74 (upper stirring member) is configured so as to be larger than the ordinary pitch in the other portions (the conveying forward screw section 74*a* and the reverse screw section 77). If the pitch-enlarged screw section 74*c* exists in a long distance, the developer-tank-contained developer 3 is mixed/stirred insufficiently; or if the second screw 74 is long, the developing device 34 becomes large in size, thereby being disadvantageous in design; for these reasons, it is undesirable that the pitch-enlarged screw section 74*c* extends in a distance longer than necessary. The pitch in the pitch-enlarged screw section 74*c* is preferably 1.2 to 2.5 times the ordinary pitch in the other portions, for example, and further preferably 1.5 to 2 times. Furthermore, the pitch-enlarged screw section 74*c* extends so as to overlap the lower wall section 61 and the circulating flow outlet 63 provided at the upper end section thereof.

In the respective embodiments 1 to 4 described above, it has been verified that the developer-tank-contained developer 3 is easily conveyed to the circulating flow outlet 63 provided at the upper end section of the lower wall section 61 by providing the pitch-enlarged screw section 74*c* for the second screw 74 (upper stirring member). In other words, the developer-tank-contained developer 3 can be guided to the circulating flow outlet 63 by optimizing the second screw 74 (upper stirring member), whereby the design freedom of the developing device 34 can be increased.

In the respective embodiments 1 to 5 described above, the developer-tank-contained developer 3 is pushed out from the circulating flow outlet 63 provided in the side wall of the upper conveying passage 70 by the conveying force of the second screw 74 (upper stirring member). A case in which a first communicating passage 71 for nearly continuously connecting the upper conveying passage 70 to the lower conveying passage 68 is disposed obliquely downward with respect to the horizontal plane will be described below.

An image forming apparatus 1 according to a sixth embodiment of the present invention and a developing device 34 being used for the apparatus will be described referring to FIGS. 12 to 17.

[Image Forming Apparatus]

Figure 12:
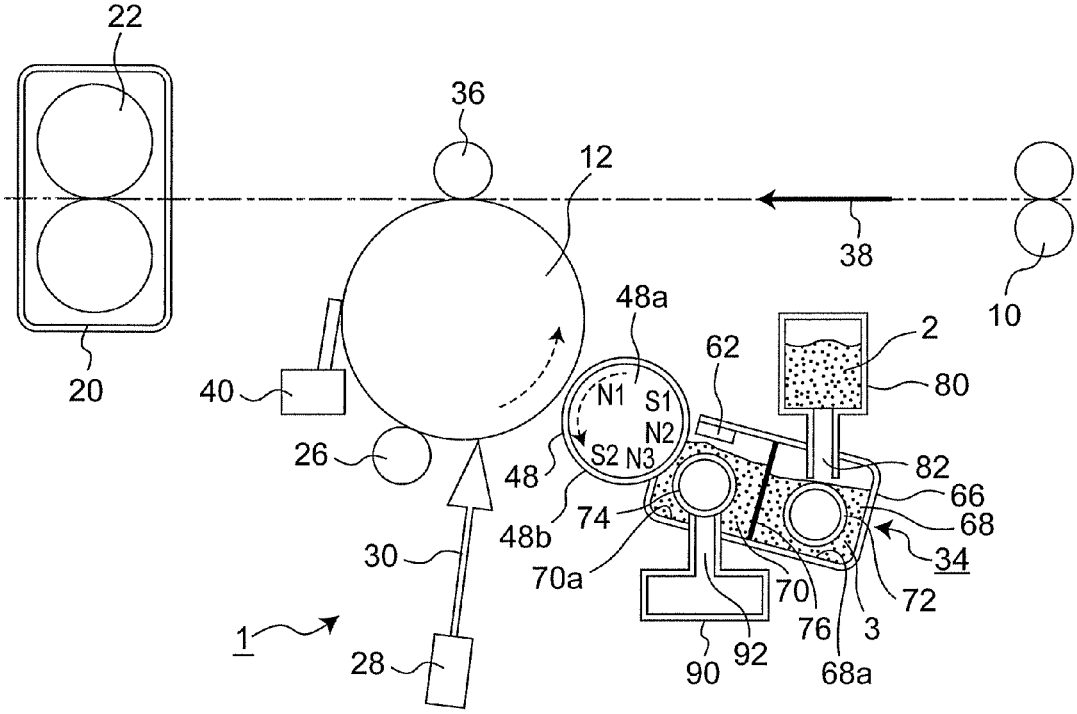
FIG. 12 is a view showing the schematic configuration of an image forming apparatus according to a sixth embodiment of the present invention.

FIG. 12 shows the components relating to image formation in the electrophotographic image forming apparatus 1 according to the sixth embodiment of the present invention. The image forming apparatus 1 may be a copier, a printer, a facsimile machine or a compound machine combinedly equipped with the functions of these. The image forming apparatus 1 has a photosensitive member 12 serving as an electrostatic latent image holder. Although the photosensitive member 12 is formed of a cylinder in this embodiment, the photosensitive member 12 is not limited to have such a shape in the present invention, but it is possible to use an endless belt-type photosensitive member instead. The photosensitive member 12 is connected to a motor (not shown) so as to be driven and is rotated on the basis of the driving of the motor in the direction indicated by the arrow. Around the circumference of the photosensitive member 12, a charging device 26, an exposure device 28, a developing device 34, a transfer device 36 and a cleaning device 40 are respectively arranged along the rotation direction of the photosensitive member 12.

The charging device 26 charges the photosensitive layer, that is, the outer circumferential face of the photosensitive member 12, to a predetermined potential. Although the charging device 26 is represented as a cylindrical roller in this embodiment, instead of this, it is also possible to use charging devices of other forms (for example, a rotary or fixed brush type charging device and a wire discharging type charging device). The exposure device 28 disposed at a position close to or away from the photosensitive member 12 emits image light 30 toward the outer circumferential face of the charged photosensitive member 12. An electrostatic latent image having an area wherein the image light 30 is projected and the charged potential is attenuated and an area wherein the charged potential is almost maintained is formed on the outer circumferential face of the photosensitive member 12 that has passed the exposure device 28. In this embodiment, the area wherein the charged potential is attenuated is the image area of the electrostatic latent image, and the area wherein the charged potential is almost maintained is the non-image area of the electrostatic latent image. The developing device 34 develops the electrostatic latent image into a visible image using a developer-tank-contained developer 3 described later. The details of the developing device 34 are described later. The transfer device 36 transfers the visible image formed on the outer circumferential face of the photosensitive member 12 onto paper 38 or film. Although the transfer device 36 is shown as a cylindrical roller in the embodiment shown in FIG. 12, it is also possible to use transfer devices having other forms (for example, a wire discharging type transfer device). The cleaning device 40 recovers non-transferred toner not transferred to the paper 38 by the transfer device 36 but remaining on the outer circumferential face of the photosensitive member 12 from the outer circumferential face of the photosensitive member 12. Although the cleaning device 40 is shown as a plate-like blade in this embodiment, instead of this, it is also possible to use cleaning devices having other forms (for example, a rotary or fixed brush-type cleaning device).

When the image forming apparatus 1 configured as described above forms an image, the photosensitive member 12 is rotated counterclockwise, for example, on the basis of the driving of the motor (not shown). At this time, the outer circumferential area of the photosensitive member 12 passing the charging device 26 is charged to a predetermined potential at the charging device 26. The outer circumferential area of the charged photosensitive member 12 is exposed to the image light 30 at the exposure device 28, and an electrostatic latent image is formed. As the photosensitive member 12 is rotated, the electrostatic latent image is conveyed to the developing device 34 and developed into a visible image using the developing device 34. As the photosensitive member 12 is rotated, the toner image developed into the visible image is conveyed to the transfer device 36 and transferred to the paper 38 using the transfer device 36. The paper 38 to which the toner image is transferred is conveyed to a fixing device 20, and the toner image is fixed to the paper 38. The outer circumferential area of the photosensitive member 12 having passed the transfer device 36 is conveyed to the cleaning device 40 in which the toner not transferred to the paper 38 but remaining on the outer circumferential face of the photosensitive member 12 is scraped off from the photosensitive member 12.

[Developing Device]

The developing device 34 is provided with a two-component developer containing non-magnetic toner (hereafter simply referred to as toner) and magnetic carrier (hereafter simply referred to as carrier) and a developer tank 66 accommodating various members. The developer tank 66 has an opening section being open toward the photosensitive member 12, and a developing roller 48 is installed in a space formed near the opening section. The developing roller 48 serving as a developer holder is a cylindrical member that is rotatably supported in parallel with the photosensitive member 12 while having a predetermined developing gap to the outer circumferential face of the photosensitive member 12.

The developing roller 48 is the so-called magnetic roller having a magnet 48*a* secured so as not to be rotatable and a cylindrical sleeve 48*b* (first rotating cylinder) supported so as to be rotatable around the circumference of the magnet 48*a*. Above the sleeve 48*b* of the developing roller 48, a regulating plate 62 secured to the developer tank 66 and extending in parallel with the center axis of the sleeve 48*b* of the developing roller 48 is disposed so as to be opposed thereto with a predetermined regulating gap therebetween. The magnet 48*a* disposed inside the developing roller 48 has five magnetic poles N1, S2, N3, N2 and S1 in the rotation direction of the sleeve 48*b*. Among these magnetic poles, the main magnetic pole N1 is disposed so as to be opposed to the photosensitive member 12. The magnetic poles N2 and N3 having the same polarity and generating a repulsive magnetic field for detaching the developer from the surface of the sleeve 48*b* are disposed so as to be opposed to each other inside the developer tank 66. The sleeve 48*b* of the developing roller 48 rotates in the direction opposite to the rotation direction of the photosensitive member 1 (counter direction).

Figure 13:
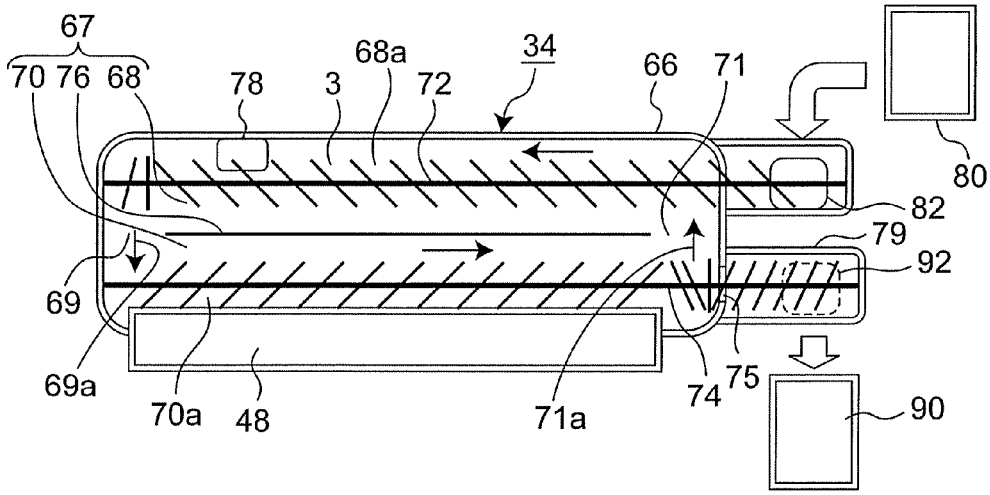
FIG. 13 is a schematic sectional view showing the developing device of the image forming apparatus shown in FIG. 12 as seen from above.

FIG. 13 is a schematic sectional view showing the developing device 34 as seen from above. As shown in FIG. 13, a developer stirring and conveying chamber 67 is formed behind the developing roller 48. The developer stirring and conveying chamber 67 comprises an upper conveying passage 70 formed near the developing roller 48, a lower conveying passage 68 formed away from the developing roller 48 and a partition wall 76 for partitioning the space between the lower conveying passage 68 and the upper conveying passage 70. Above the upstream side in the conveying direction of the lower conveying passage 68, a developer replenishing tank 80 is disposed, and the developer replenishing tank 80 communicates with the lower conveying passage 68 via a replenishing port 82. The developer replenishing tank 80 is filled with a replenishment developer 2 containing toner as a major ingredient and carrier. The toner and the carrier may be replenished separately. The ratio of the carrier in the replenishment developer 2 is preferably 5 to 40 wt %, further preferably 10 to 30 wt %. In addition, below the downstream side in the conveying direction of the upper conveying passage 70, a developer recovery tank 90 is disposed and the upper conveying passage 70 communicates with the developer recovery tank 90 via a recovery port 92.

At the bottom of the developer replenishing tank 80, a developer supplying roller is disposed, the driving operation of which is controlled using a controller 100. When the developer supplying roller is driven and rotated, the replenishment developer 2, which is fresh and the amount of which corresponds to the driving time of the roller, flows downward and is supplied to the lower conveying passage 68 of the developer tank 66.

In the lower conveying passage 68, a first screw 72 serving as a stirring member for conveying the developer-tank-contained developer 3 while stirring the developer is rotatably supported. In the upper conveying passage 70, a second screw 74 for conveying the developer-tank-contained developer 3 from the lower conveying passage 68 to the developing roller 48 while stirring the developer is rotatably supported. In this case, the portions of the partition wall 76 located at both end sections of the upper conveying passage 70 and the lower conveying passage 68 are cut out, and communicating passages are formed. In other words, in FIG. 13, the first communicating passage 71 for nearly continuously connecting the downstream side of the upper conveying passage 70 to the upstream side of the lower conveying passage 68 is formed on the right side of the partition wall 76, and on the left side of the partition wall 76, a second communicating passage 69 for nearly continuously connecting the downstream side of the lower conveying passage 68 to the upstream side of the upper conveying passage 70 is formed. As a result, a circulation passage through which the developer-tank-contained developer 3 circulates is formed using the upper conveying passage 70, the first communicating passage 71, the lower conveying passage 68 and the second communicating passage 69. The developer-tank-contained developer 3 circulates inside the developer stirring and conveying chamber counterclockwise in the direction indicated by the arrow shown in FIG. 13, for example. The upper conveying passage 70 is configured so as to be positioned at a level as high as or higher than the lower conveying passage 68 as described later.

As shown in FIGS. 12 and 17, in the developing device 34 according to the sixth embodiment of the present invention, the upper conveying passage 70 is positioned above the lower conveying passage 68, and the first communicating passage 71 and the second communicating passage 69 are tilted. More specifically, the first communicating passage 71 and the second communicating passage 69 have nearly flat faces, and these faces are tilted.

Figure 17A:
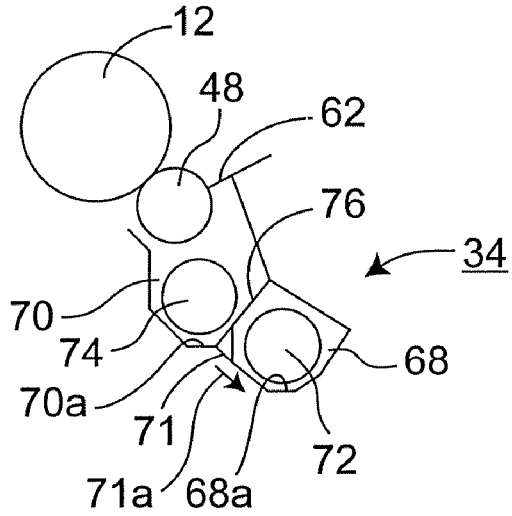
FIG. 17A is a schematic side view showing the developing device as seen from the side of a developer discharging section according to a sixth embodiment of the present invention.
Figure 17B:
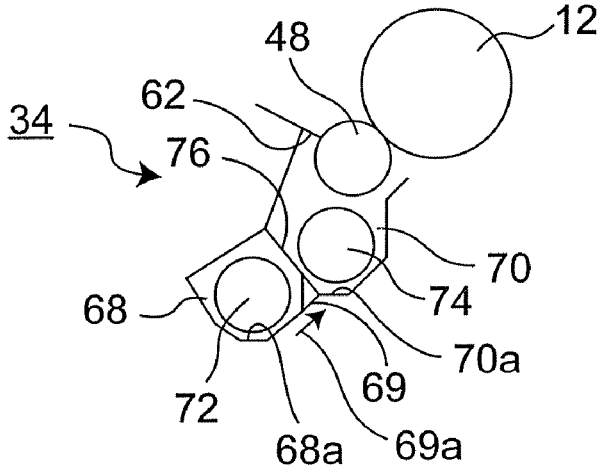
FIG. 17B is a schematic side view showing the developing device as seen from the opposite side of the developer discharging section according to the sixth embodiment of the present invention.
Figure 17C:
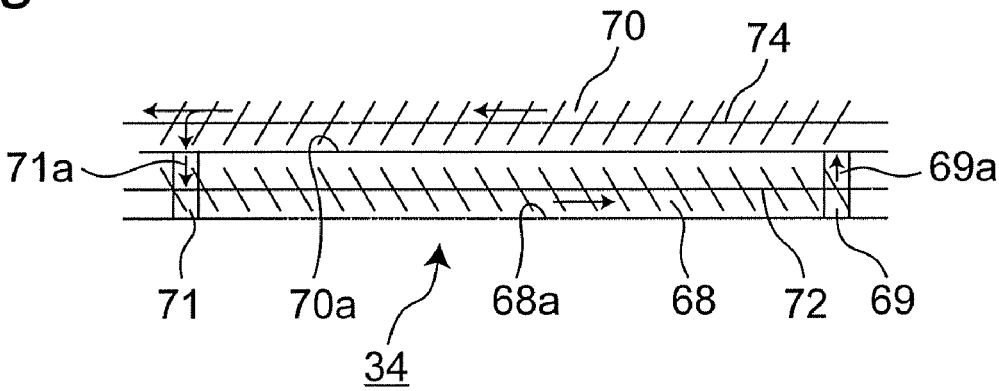
FIG. 17C is a schematic view showing the developing device as seen from the side according to the sixth embodiment of the present invention.

FIG. 17A is a schematic side view showing the developing device 34 as seen from the side of the developer discharging section 79 according to the sixth embodiment of the present invention, FIG. 17B is a schematic side view showing the developing device 34 as seen from the opposite side of the developer discharging section 79 according to the sixth embodiment of the present invention, and FIG. 17C is a schematic view showing the developing device 34 as seen from the side according to the sixth embodiment of the present invention.

The developing device 34 according to the sixth embodiment shown in FIGS. 17A, 17B, and 17C is configured such that the bottom face 70*a* of the upper conveying passage 70 and the bottom face 68*a* of the lower conveying passage 68 are nearly parallel and such that the outside diameter of the second screw 74 (upper stirring member) and the outside diameter of the first screw 72 (lower stirring member) are substantially identical.

Both the bottom face 70*a* of the upper conveying passage 70 and the bottom face 68*a* of the lower conveying passage 68 extend in a nearly horizontal direction, and the bottom face 70*a* of the upper conveying passage 70 is positioned above the bottom face 68*a* of the lower conveying passage 68. Since the first communicating passage 71 is a passage for connecting the bottom face 70*a* of the upper conveying passage 70 positioned above to the bottom face 68*a* of the lower conveying passage 68 positioned below on the discharge side of the developing device 34, the first communicating passage 71 is configured so as to be tilted obliquely downward with respect to the horizontal plane.

The obliquely downward arrow 71*a* in FIG. 17A indicates the obliquely downward flow of the developer-tank-contained developer 3 that is conveyed along the first communicating passage 71, and the obliquely upward arrow 69*a* in FIG. 17B indicates the obliquely upward flow of the developer-tank-contained developer 3 that is conveyed along the second communicating passage 69. In FIG. 17C, the arrow branched leftward on the discharge side of the developing device 34 indicates the flow of the developer-tank-contained developer 3 that is conveyed toward the developer discharging section 79, and the arrow branched downward on the discharge side of the developing device 34 indicates the flow of the developer-tank-contained developer 3 that is conveyed toward the first communicating passage 71. Hence, as shown in FIG. 17C, part of the developer-tank-contained developer 3 is conveyed obliquely downward in the first communicating passage 71, conveyed in the lower conveying passage 68 in a nearly horizontal direction, conveyed obliquely upward in the second communicating passage 69, and conveyed in the upper conveying passage 70 in a nearly horizontal direction; and the other part of the developer-tank-contained developer 3 is conveyed toward the developer discharging section 79.

Excessive discharge of the developer-tank-contained developer 3 to the developer discharging section 79 can be restricted using the first communicating passage 71 tilted obliquely downward with respect to the horizontal plane even when the developing device 34 is tilted such that the discharge side thereof is positioned low.

Since the outside diameter of the second screw 74 (upper stirring member) and the outside diameter of the first screw 72 (lower stirring member) are connected so as to be substantially identical, the second screw 74 (upper stirring member) and the first screw 72 (lower stirring member) can be used commonly, whereby parts control can be facilitated and cost can be reduced. In addition, since the screws 72 and 74 being compact in size are used, space saving can be achieved for the developing device 66. Furthermore, since a space is formed between the lower side of the bottom face 70*a* of the upper conveying passage 70 and the side face of the lower conveying passage 68, other components can be disposed and installed in this space.

Figure 14:
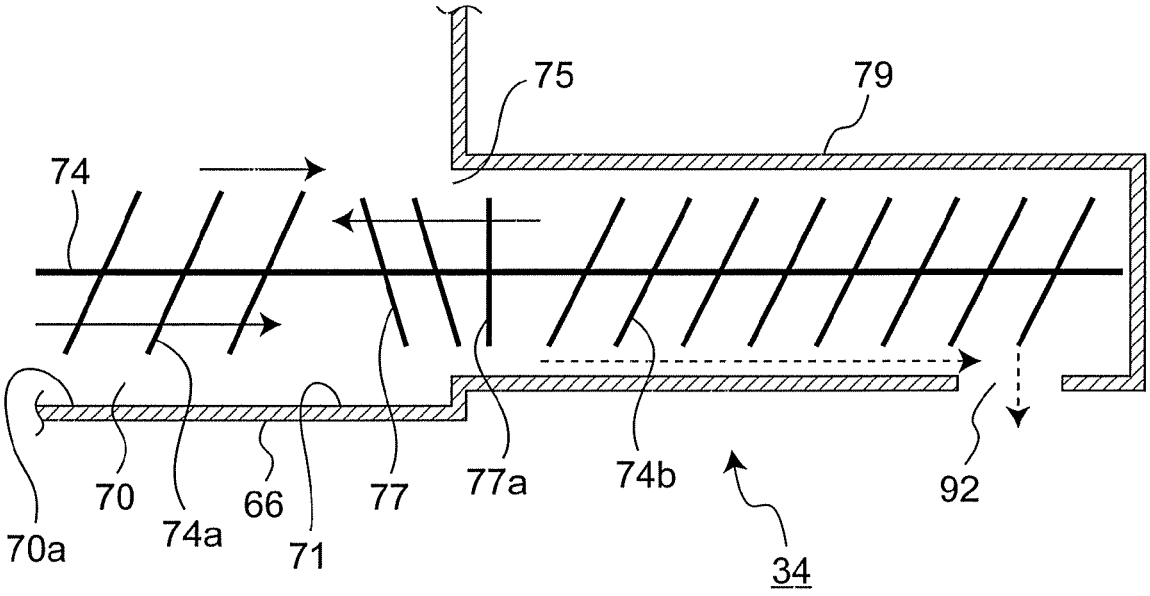
FIG. 14 is a schematic sectional view showing part of the developing device of the image forming apparatus shown in FIG. 12 as seen from the side.

The first screw 72 and the second screw 74 are each a spiral screw in which a spiral vane with a predetermined pitch is secured to a shaft. FIG. 14 is a schematic sectional view showing the developer discharging section 79 and its periphery, that is, part of the developing device 34, as seen from the side and corresponding to the right end section shown in FIG. 13. As shown in FIG. 14, the second screw 74 extends rightward in the figure and further extends above the recovery port 92.

The second screw 74 has a conveying forward screw section 74*a* extending to the upper conveying passage 70 and a discharging forward screw section 74*b* extending to the developer discharging section 79 positioned at the downstream side end section (the right end section in FIG. 13) in the conveying direction. The conveying forward screw section 74*a* conveys the developer-tank-contained developer existing in the developer tank 66 to the developer discharging section 79. The discharging forward screw section 74*b* conveys the developer existing inside the developer discharging section 79 to the recovery port 92.

In addition, at each of the positions corresponding to the first communicating passage 71 from the upper conveying passage 70 toward the lower conveying passage 68 and to the downstream side end section of the lower conveying passage 68, the second screw 74 has a reverse screw section 77 in which the spiral direction of the spiral screw is opposite to that at the other section. A stopping member 77*a* is provided on the side of the developer discharging section 79 of the reverse screw section 77. The stopping member 77*a* is a nearly disc-shaped member extending in the direction orthogonal to the rotation shaft of the second screw 74 and has an action of restricting the rising of the developer-tank-contained developer 3 formed using the reverse screw section 77 from moving to the side of the developer discharging section 79.

When the second screw 74 rotates, a reverse flow for moving the developer-tank-contained developer 3 from the developer discharging section 79 to the upper conveying passage 70 is generated using the reverse screw section 77 as indicated by the leftward arrow in FIG. 14. As a result, when the second screw 74 rotates, the level of the developer-tank-contained developer 3 at the downstream side end section (the right end section) in the conveying direction of the second screw 74 becomes higher than that at the other section. In other words, a rising of the developer-tank-contained developer 3 is formed at the downstream side end section (the right end section) in the conveying direction of the upper conveying passage 70, that is, the reverse screw section 77. Furthermore, the stopping member 77*a* restricts the rising of the developer-tank-contained developer 3 from moving to the side of the developer discharging section 79.

Since the developing device 34 employs the so-called trickle system, the developing device has an excessive flow outlet 75 for allowing an excessive amount of the developer-tank-contained developer 3 to flow out. In other words, the outlet 75 is provided as the excessive flow cutout 75 that is formed by partially cutting out the upper portion of the side wall located at the downstream side end section (the right end section) in the conveying direction of the upper conveying passage 70. The excessive flow outlet 75 is provided on the downstream side (that is, on the side of the developer discharging section 79) from the first communicating passage 71. In a usual state, the developer being conveyed using the second screw 74 is stopped using the reverse screw section 77 and the stopping member 77*a* and conveyed from the upper conveying passage 70 to the lower conveying passage 68 via the opening section 65 (circulating flow outlet 63) as indicated by the solid-line arrows shown in FIGS. 13 and 14. When the developer-tank-contained developer 3 increases inside the developer tank and the developer level inside the developer tank rises, the developer-tank-contained developer 3 climbs over the excessive flow outlet 75 provided at the upper portion of the side wall against the damming action of the reverse screw section 77 and the stopping member 77*a* and overflows to the developer discharging section 79 adjacent thereto. The excessive amount of the developer-tank-contained developer 3 overflowed to the developer discharging section 79 is conveyed to the recovery port 92 in the directions indicated by the broken-line arrows shown in FIG. 14 and recovered (dumped) into the developer recovery tank 90 via the recovery port 92.

As shown in FIG. 13, in the developer stirring and conveying chamber 67, a toner concentration detecting sensor 78 for detecting the toner concentration inside the developer stirring and conveying chamber 67 is provided. The toner concentration detecting sensor 78 detects the permeability of the developer-tank-contained developer 3 being conveyed inside the developer stirring and conveying chamber 67 on the basis of the change in the inductance of a coil, for example. The ratio of the toner in the developer-tank-contained developer 3 is obtained on the basis of the permeability detected using the toner concentration detecting sensor 78. For example, when the amount of the carrier contained in the developer-tank-contained developer 3 is small, it is detected that the ratio of the toner is high. On the other hand, when the amount of the carrier contained in the developer-tank-contained developer 3 is large, it is detected that the ratio of the toner is low. In addition, the voltage signal output from the toner concentration detecting sensor 78 is input to the controller 100, a required replenishing amount is calculated on the basis of the detection signal, the developer replenishing roller of the developer replenishing tank 80 is driven, and the predetermined amount of the replenishment developer 2 is replenished into the developer tank 66.

In the developing device 34, when the toner concentration of the circulating developer-tank-contained developer 3 lowers as the image formation operation proceeds, the replenishment developer 2 containing toner and a small amount of carrier is replenished from the developer replenishing tank 80. The replenishment developer 2 having been replenished is conveyed along the lower conveying passage 68 and the upper conveying passage 70 of the above-mentioned developer stirring and conveying chamber 67 while being mixed and stirred with the developer-tank-contained developer 3 already existing therein. Although the toner is basically consumed on the photosensitive member 12, the carrier is accumulated inside the developing device 34, and the charging performance of the carrier lowers gradually. Since a small amount of the carrier that is bulkier than the toner is contained in the replenishment developer 2, as the replenishment developer 2 is replenished, the amount of the developer-tank-contained developer 3 gradually increases inside the developing device 34. Then, the developer-tank-contained developer 3 having increased in volume circulates in the developer stirring and conveying chamber 67. An excessive amount of the developer-tank-contained developer 3 being unable to circulate in the developer stirring and conveying chamber 67 climbs over the reverse screw section 77 and flows out from the excessive flow outlet 75 provided at the downstream side end section (the right end section) in the conveying direction of the upper conveying passage 70 and is recovered in the developer recovery tank 90 via the recovery port 92.

The replenishing amount of the replenishment developer 2 is determined on the basis of the toner concentration of the developer-tank-contained developer 3 detected using the toner concentration detecting sensor 78, the image information (dot counter) at the time of image formation and the ratio of the carrier in the replenishment developer 2 inside the developer replenishing tank 80. The ratio of the carrier in the replenishment developer 2 inside the developer replenishing tank 80 is adjusted to the extent that the carrier inside the developing device 34 is suppressed from deteriorating and that the cost is not increased. As the toner replenishing operation proceeds, the carrier is supplied gradually.

The operation of the developing device 34 configured as described above will be described.

At the time of image formation, the sleeve 48*b* of the developing roller 48 is rotated in the direction indicated by the arrow (counterclockwise) on the basis of the driving of the motor (not shown). By the rotation of the first screw 72 and the rotation of the second screw 74, the developer-tank-contained developer 3 existing in the developer stirring and conveying chamber 67 is stirred while being circulated and conveyed through the lower conveying passage 68, the first communicating passage 71, the upper conveying passage 70 and the second communicating passage 69. As a result, the toner and the carrier contained in the developer make friction contact and are charged to have polarities opposite to each other. In this embodiment, it is assumed that the carrier is positively charged and that the toner is negatively charged. However, the charging characteristics of the toner and the carrier being used for the present invention are not limited to these combinations. The external size of the carrier is considerably larger than that of the toner. For this reason, the negatively charged toner is attached around the circumference of the positively charged carrier mainly on the basis of the electric attraction force exerted therebetween.

The developer-tank-contained developer 3 charged as described above is supplied to the developing roller 48 in the process of being conveyed along the upper conveying passage 70 using the second screw 74. The developer is held on the surface of the sleeve 48*b* by the magnetic force of the magnet 48*a* inside the developing roller 48 and moved while being rotated counterclockwise together with the sleeve 48*b*, the throughput thereof is regulated using the regulating plate 62 disposed so as to be opposed to the developing roller 48, and then the developer is conveyed to the developing area opposed to the photosensitive member 12. Furthermore, in the developing area, chains of particles (magnetic brush) are formed by the magnetic force of the main magnet pole N1 of the magnet 48*a*. In the developing area, by the force of the electric field (electric field of AC superimposed on DC) that is formed between the electrostatic latent image on the photosensitive member 12 and the developing roller 48 to which a developing bias is applied and exerted to the toner, the toner is moved to the electrostatic latent image on the photosensitive member 12, and the electrostatic latent image is developed into a visible image. The developer, the toner of which is consumed in the developing area, is conveyed toward the developer tank 66, detached from the surface of the developing roller 48 by the repulsive magnetic field between the poles N3 and N2 of the magnet 48*a* disposed so as to be opposed to the upper conveying passage 70 of the developer tank 66, and then recovered into the developer tank 66. The recovered developer is mixed with the developer-tank-contained developer 3 that is being conveyed to the upper conveying passage 70.

When the toner contained in the developer-tank-contained developer 3 is consumed by the image formation described above, it is desirable that the amount of the toner corresponding to the consumed amount is replenished to the developer-tank-contained developer 3. For this purpose, the developing device 34 is equipped with the toner concentration detecting sensor 78 for measuring the ratio of the toner in the developer-tank-contained developer 3 existing in the developer stirring and conveying chamber 67. Furthermore, the developer replenishing tank 80 is provided above the lower conveying passage 68.

Next, how the developer-tank-contained developer 3 flows inside the developer tank 66 when the developing device 34 according to the present invention is disposed obliquely will be described referring to FIGS. 15 and 16.

Figure 15:
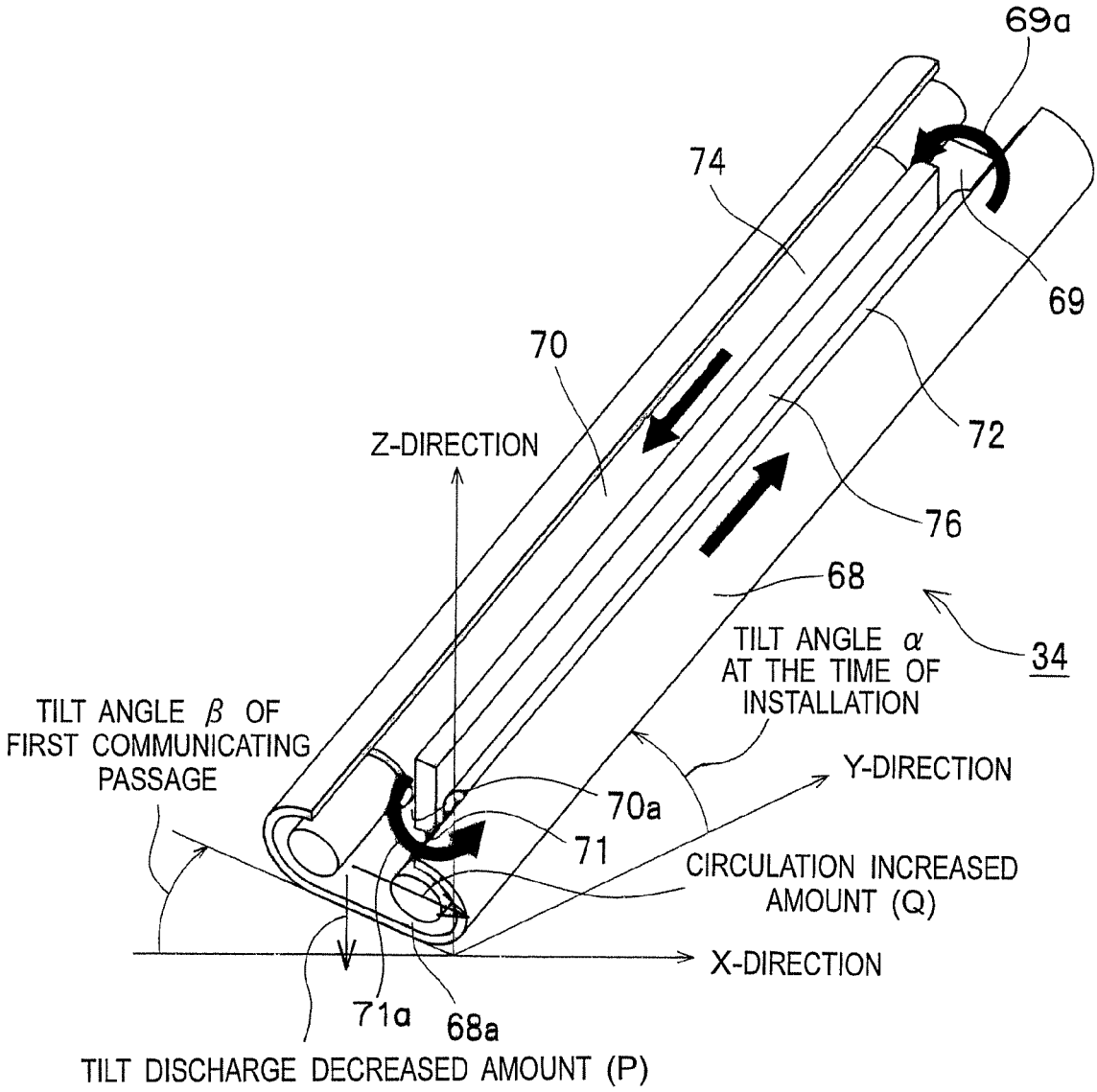
FIG. 15 is a view in the developing device according to the present invention illustrating the flow of a developer near a first communicating passage disposed obliquely when the developing device is disposed obliquely.

FIG. 15 is a view in the developing device 34 according to the present invention illustrating the flow of the developer-tank-contained developer 3 near the first communicating passage 71 disposed obliquely when the developing device 34 is disposed obliquely. Furthermore, FIG. 16 is a view in a developing device 34 according to the prior art illustrating the flow of the developer-tank-contained developer 3 near the first communicating passage 71 disposed horizontally when the developing device 34 is disposed obliquely. The black solid arrows in each figure respectively indicate the flowing directions of the developer-tank-contained developer 3.

In the conventional developing device 34, the upper conveying passage 70 and the lower conveying passage 68 are usually disposed so as to extend on nearly identical horizontal planes, the first communicating passage 71 and the second communicating passage 69 are also disposed so as to extend on nearly identical horizontal planes, and a trickle discharging mechanism (not shown) is disposed in the downstream end section of the upper conveying passage 70. In the developing device 34 disposed horizontally, ordinary discharging operation is carried out using the trickle discharging mechanism.

Figure 16:
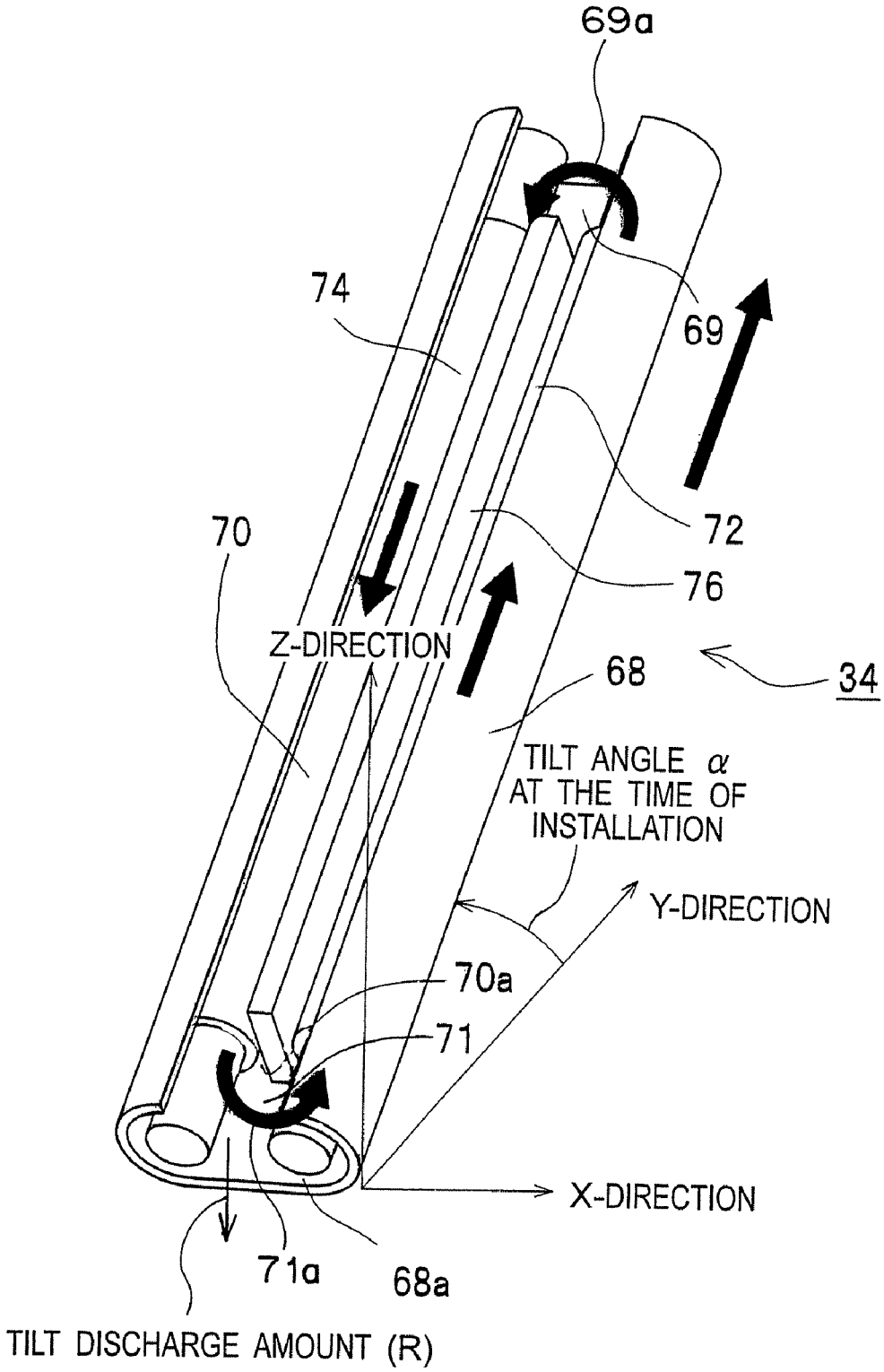
FIG. 16 is a view in a developing device according to the prior art illustrating the flow of a developer near a first communicating passage disposed horizontally when the developing device is disposed obliquely.

However, as shown in FIG. 16, the developing device 34 occasionally becomes installed in a tilted state in which the developing device 34 urges the developer-tank-contained developer 3 to be discharged. In other words, in the tilted installation shown in FIG. 16, the developing device 34 disposed so as to extend in the Y-axis direction on an X-Y horizontal plane is rotated counterclockwise around the X axis and tilted at an installation tilt angle α with respect to the X-Y horizontal plane. Hence, the developing device 34 is disposed obliquely such that the discharge side thereof is positioned below the circulation passage. In this oblique installation, a tilt discharge amount R due to the gravitational action applied to the developer-tank-contained developer 3 is added to the ordinary discharge amount discharged to the discharging mechanism in the horizontal state. At the time of the oblique installation, the tilt discharge amount R is wholly discharged to the discharging mechanism, resulting in increasing the discharge amount of the developer-tank-contained developer 3 to the side of the discharging mechanism by the tilt discharge amount R.

On the other hand, in the developing device 34 according to the present invention, the first communicating passage 71 is configured so as to be disposed obliquely downward with respect to the horizontal plane as described earlier. In other words, in comparison with the conventional horizontal disposition developing device 34 in which the first communicating passage 71 shown in FIG. 16 is disposed horizontally, the developing device 34 according to the present invention shown in FIGS. 12 and 15 disposed so as to extend in the Y-direction on the X-Y horizontal plane is configured so as to be rotated clockwise around the Y-axis and tilted at a tilt angle β with respect to the X-Y horizontal plane. As a result, the bottom face 70*a* on the downstream side of the upper conveying passage 70 is positioned above the bottom face 68*a* on the upstream side of the lower conveying passage 68, and the first communicating passage 71 is disposed obliquely downward with respect to the horizontal plane. In other words, the first communicating passage 71 is tilted downward in the gravitational direction at the tilt angle β with respect to the X-Y horizontal plane.

The developing device 34 according to the present invention is also disposed obliquely in some cases such that the discharge side thereof is positioned low as shown in FIG. 15. In such a case, the tilt discharge amount R due to the gravitational action applied to the developer-tank-contained developer 3 is added to the ordinary discharge amount discharged to the discharging mechanism in the horizontal state.

However, since the first communicating passage 71 is configured so as to be tilted obliquely downward with respect to the X-Y horizontal plane, the component force of the gravitational force toward the first communicating passage 71 acts on the developer-tank-contained developer 3 conveyed near the first communicating passage 71, and the developer-tank-contained developer 3 is guided to the first communicating passage 71. As a result, at the time of the tilted disposition, the first communicating passage 71 tilted obliquely downward with respect to the X-Y horizontal plane has a function of positively guiding part of the developer-tank-contained developer 3 conveyed near the first communicating passage 71 to the lower conveying passage 68 constituting the circulation passage. By virtue of the existence of the first communicating passage 71 tilted obliquely downward with respect to the X-Y horizontal plane, part of the tilt discharge amount R, an increased amount toward the developer discharging section 79, is conveyed as a circulation increased amount Q to the lower conveying passage 68 while being guided by the first communicating passage 71. Furthermore, a tilt discharge decreased amount P obtained by subtracting the circulation increased amount Q from the tilt discharge amount R is conveyed to the developer discharging section 79.

Hence, the increment (R) of the discharge amount of the developer-tank-contained developer 3, obtained when the developing device 34 is disposed obliquely at the tilt angle β, satisfies the relationship of the tilt discharge amount (R)=the tilt discharge decreased amount (P)+the circulation increased amount (Q). In the developing device 34 disposed obliquely such that the discharge side thereof is positioned low, since the increment (R) of the discharge amount of the developer-tank-contained developer 3 to be conveyed to the developer discharging section 79 is decreased by the circulation increased amount (Q), and the tilt discharge decreased amount (P) is obtained as described above, excessive discharge of the developer-tank-contained developer 3 to the developer discharging section 79 can be restricted. Furthermore, since the reverse screw section 77 acting to prevent the developer-tank-contained developer 3 from moving toward the discharging mechanism is provided on the downstream side of the upper conveying passage 70, the developer-tank-contained developer 3 having increased in amount by the tilt disposition is stopped but moves positively toward the first communicating passage 71 that is open downward. By virtue of this action based on the configuration of the present invention, excessive discharge of the developer-tank-contained developer 3 can be prevented even if the developing device 34 is disposed obliquely.

Therefore, in the case in which the first communicating passage 71 tilted obliquely downward is provided, the gravitational force applied to the developer-tank-contained developer 3 acts on the developer-tank-contained developer 3 in addition to the conveying force of the second screw 74 (upper stirring member), and the force of guiding the developer-tank-contained developer 3 existing in the upper conveying passage 70 toward the lower conveying passage 68 increases in comparison with the case in which the circulating flow outlet 63 described earlier is provided.

Next, the characteristic sections of the developing device 34 and the operations thereof according to a seventh embodiment of the present invention will be described referring to FIGS. 18A, 18B, and 18C. However, since the configurations of the sections other than those of the characteristic sections according to the seventh embodiment are the same as those according to the above-mentioned sixth embodiment, the description regarding the configurations of the sections other than those of the characteristic sections is omitted.

Figure 18A:
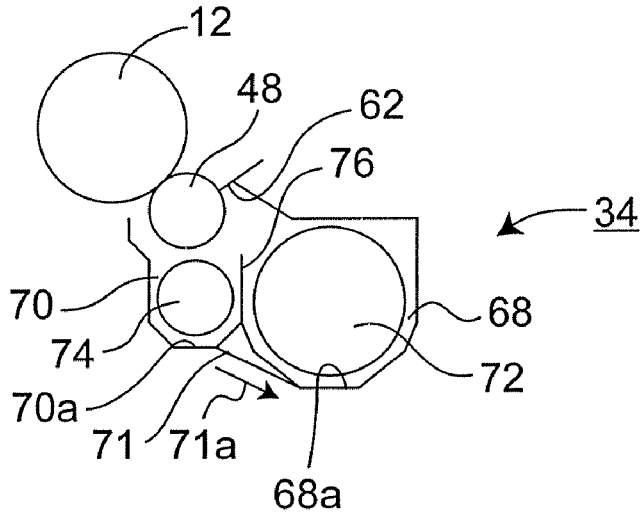
FIG. 18A is a schematic side view showing the developing device as seen from the side of a developer discharging section according to a seventh embodiment of the present invention.
Figure 18B:
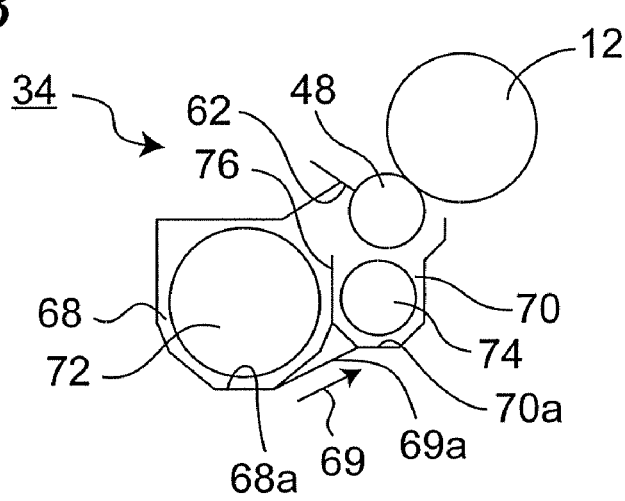
FIG. 18B is a schematic side view showing the developing device as seen from the opposite side of the developer discharging section according to the seventh embodiment of the present invention.
Figure 18C:
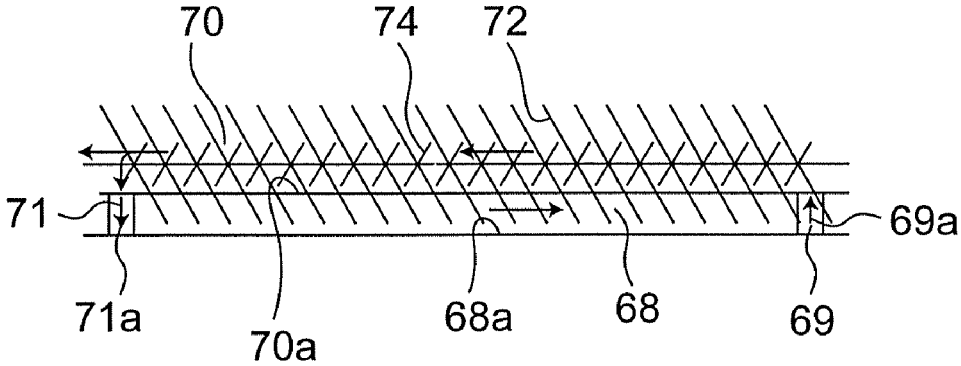
FIG. 18C is a schematic view showing the developing device as seen from the side according to the seventh embodiment of the present invention.

FIG. 18A is a schematic side view showing the developing device 34 as seen from the side of the developer discharging section 79 according to the seventh embodiment of the present invention, FIG. 18B is a schematic side view showing the developing device 34 as seen from the opposite side of the developer discharging section 79 according to the seventh embodiment of the present invention, and FIG. 18C is a schematic view showing the developing device 34 as seen from the side according to the seventh embodiment of the present invention.

The developing device 34 according to the seventh embodiment shown in FIGS. 18A, 18B, and 18C is a variation example of the above-mentioned sixth embodiment and is configured such that the bottom face 70*a* of the upper conveying passage 70 is nearly parallel with the bottom face 68*a* of the lower conveying passage 68 and such that the outside diameter of the first screw 72 (lower stirring member) is larger than the outside diameter of the second screw 74 (upper stirring member). In the example shown in FIGS. 8A, 8B, and 8C, the rotation shaft of the first screw 72 (lower stirring member) and the rotation shaft of the second screw 74 (upper stirring member) extend on nearly identical horizontal planes; however, the two rotation shafts are not necessarily required to extend on the nearly identical horizontal planes.

Both the bottom face 70*a* of the upper conveying passage 70 and the bottom face 68*a* of the lower conveying passage 68 extend in a nearly horizontal direction, and the bottom face 70*a* of the upper conveying passage 70 is positioned above the bottom face 68*a* of the lower conveying passage 68. Since the first communicating passage 71 is a passage for connecting the bottom face 70*a* of the upper conveying passage 70 positioned above to the bottom face 68*a* of the lower conveying passage 68 positioned below on the discharge side of the developing device 34, the first communicating passage 71 is configured so as to be tilted obliquely downward with respect to the horizontal plane.

The obliquely downward arrow 71*a* in FIG. 18A indicates the obliquely downward flow of the developer-tank-contained developer 3 that is conveyed along the first communicating passage 71, and the obliquely upward arrow 69*a* in FIG. 18B indicates the obliquely upward flow of the developer-tank-contained developer 3 conveyed along the second communicating passage 69. In FIG. 18C, the arrow branched leftward on the discharge side of the developing device 34 indicates the flow of the developer-tank-contained developer 3 that is conveyed toward the developer discharging section 79, and the arrow branched downward on the discharge side of the developing device 34 indicates the flow of the developer-tank-contained developer 3 that is conveyed toward the first communicating passage 71. Hence, as shown in FIG. 18C, part of the developer-tank-contained developer 3 is conveyed obliquely downward in the first communicating passage 71, conveyed in a nearly horizontal direction in the lower conveying passage 68, conveyed obliquely upward in the second communicating passage 69, and conveyed in a nearly horizontal direction in the upper conveying passage 70; and the other part of the developer-tank-contained developer 3 is conveyed toward the developer discharging section 79.

Even when the outside diameter of the first screw 72 (lower stirring member) is configured so as to be larger than the outside diameter of the second screw 74 (upper stirring member), the first communicating passage 71 tilted obliquely downward with respect to the horizontal plane can be formed. Excessive discharge of the developer-tank-contained developer 3 to the developer discharging section 79 can be restricted using the first communicating passage 71 even when the developing device 34 is tilted such that the discharge side thereof is positioned low. Furthermore, since the second screw 74 (upper stirring member) is configured so as to be large, the force for conveying the developer-tank-contained developer 3 is increased, whereby it becomes easy to push up and convey the developer-tank-contained developer 3 from the lower conveying passage 68 to the upper conveying passage 70 via the second communicating passage 69.

Next, the characteristic sections of the developing device 34 and the operations thereof according to an eighth embodiment of the present invention will be described referring to FIGS. 19A, 19B, and 19C. However, since the configurations of the sections other than those of the characteristic sections according to the eighth embodiment are the same as those according to the above-mentioned sixth embodiment, the description regarding the configurations of the sections other than those of the characteristic sections is omitted.

Figure 19A:
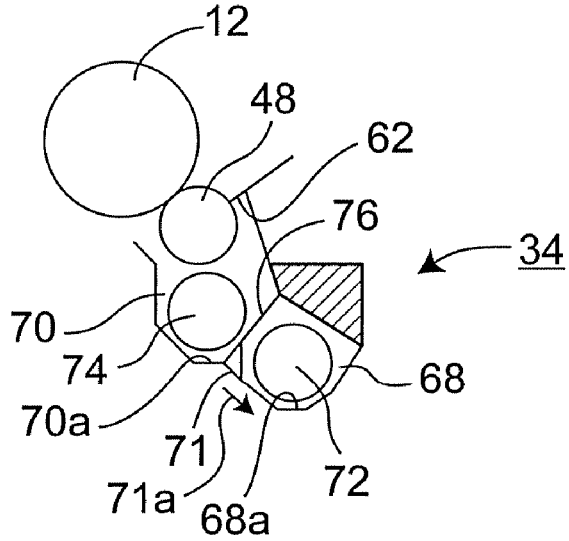
FIG. 19A is a schematic side view showing the developing device as seen from the side of a developer discharging section according to an eighth embodiment of the present invention.
Figure 19B:
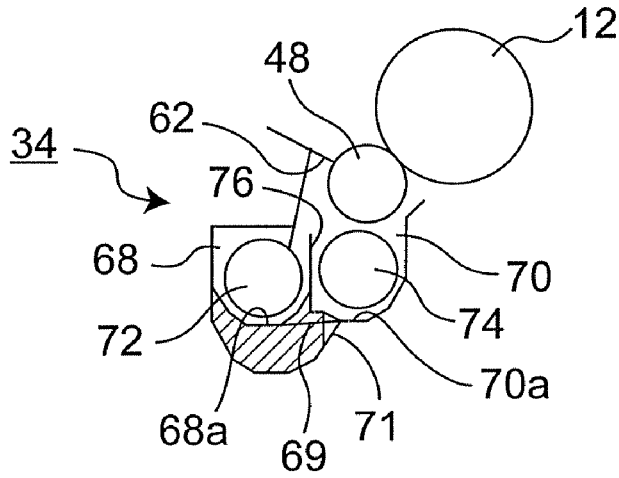
FIG. 19B is a schematic side view showing the developing device as seen from the opposite side of the developer discharging section according to the eighth embodiment of the present invention.
Figure 19C:
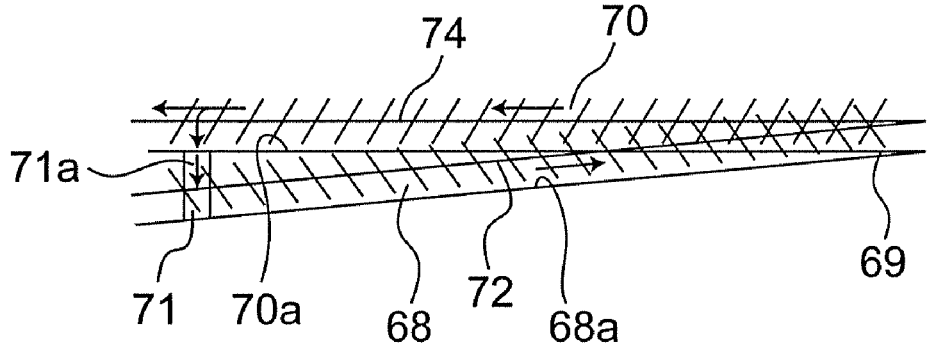
FIG. 19C is a schematic view showing the developing device as seen from the side according to the eighth embodiment of the present invention.

FIG. 19A is a schematic side view showing the developing device 34 as seen from the side of the developer discharging section 79 according to the eighth embodiment of the present invention, FIG. 19B is a schematic side view showing the developing device 34 as seen from the opposite side of the developer discharging section 79 according to the eighth embodiment of the present invention, and FIG. 19C is a schematic view showing the developing device 34 as seen from the side according to the eighth embodiment of the present invention.

The developing device 34 according to the eighth embodiment shown in FIGS. 19A, 19B, and 19C is a variation example of the above-mentioned sixth embodiment and is configured such that the distance between the bottom face 70*a* of the upper conveying passage 70 and the bottom face 68*a* of the lower conveying passage 68 is larger on the side of the first communicating passage 71 and is smaller on the side of the second communicating passage 69, and such that the outside diameter of the second screw 74 (upper stirring member) and the outside diameter of the first screw 72 (lower stirring member) are substantially identical. In the example shown in FIGS. 19A, 19B, and 19C, both the downstream side portion of the bottom face 68*a* of the lower conveying passage 68 and the upstream side portion of the bottom face 70*a* of the upper conveying passage 70, being connected to each other using the second communicating passage 69, extend on nearly identical horizontal planes; however, the downstream side portion of the bottom face 68*a* and the upstream side portion of the bottom face 70*a*, being connected to the second communicating passage 69, are not necessarily required to extend on the nearly identical horizontal planes; the downstream side portion of the bottom face 68*a* may be configured so as to be higher than the upstream side portion of the bottom face 70*a*.

The bottom face 70*a* of the upper conveying passage 70 extending in a nearly horizontal direction is positioned at a level nearly as high as or higher than the bottom face 68*a* of the lower conveying passage 68. In the bottom face 68*a* of the lower conveying passage 68, the discharge side thereof, that is, the side on the first communicating passage 71, is disposed low, and the side on the opposite side of the discharge side, that is, the side on the second communicating passage 68, is disposed high. Hence, the bottom face 68*a* of the lower conveying passage 68 is tilted obliquely upward with respect to the horizontal plane as seen from the side of the developer discharging section 79.

The obliquely downward arrow 71*a* in FIG. 19A indicates the obliquely downward flow of the developer-tank-contained developer 3 that is conveyed along the first communicating passage 71. In FIG. 19C, the arrow branched leftward on the discharge side of the developing device 34 indicates the flow of the developer-tank-contained developer 3 that is conveyed toward the developer discharging section 79, and the arrow branched downward on the discharge side of the developing device 34 indicates the flow of the developer-tank-contained developer 3 that is conveyed toward the first communicating passage 71. Hence, as shown in FIG. 19C, part of the developer-tank-contained developer 3 is conveyed downward in the first communicating passage 71, conveyed obliquely upward in the lower conveying passage 68, conveyed in a nearly horizontal direction in the second communicating passage 69, and conveyed in a nearly horizontal direction in the upper conveying passage 70; and the other part of the developer-tank-contained developer 3 is conveyed toward the developer discharging section 79.

Excessive discharge of the developer-tank-contained developer 3 to the developer discharging section 79 can be restricted using the first communicating passage 71 tilted obliquely downward with respect to the horizontal plane even when the developing device 34 is tilted such that the discharge side thereof is positioned low.

Since the outside diameter of the second screw 74 (upper stirring member) and the outside diameter of the first screw 72 (lower stirring member) are substantially identical, the second screw 74 (upper stirring member) and the first screw 72 (lower stirring member) can be used commonly, whereby parts control can be facilitated and cost can be reduced. In addition, since the screws 72 and 74 being compact in size are used, space saving can be achieved for the developing device 66. Furthermore, since a space is formed between the lower side of the bottom face 70*a* of the upper conveying passage 70 and the side face of the lower conveying passage 68 although the space is slightly smaller than that in the developing device 34 according to the sixth embodiment, other components can be disposed and installed in this space. Moreover, since the downstream side portion of the bottom face 68*a* is positioned at a level as high as or higher than the upstream side portion of the bottom face 70*a*, it is not necessary to push up the developer-tank-contained developer 3 along the second communicating passage 69, whereby the rotation drive torque applied when the first screw 72 (lower stirring member) is driven and rotated is reduced.

Next, the characteristic sections of the developing device 34 and the operations thereof according to a ninth embodiment of the present invention will be described referring to FIGS. 20A, 20B, and 20C. However, since the configurations of the sections other than those of the characteristic sections according to the ninth embodiment are the same as those according to the above-mentioned sixth embodiment, the description regarding the configurations of the sections other than those of the characteristic sections is omitted.

Figure 20A:
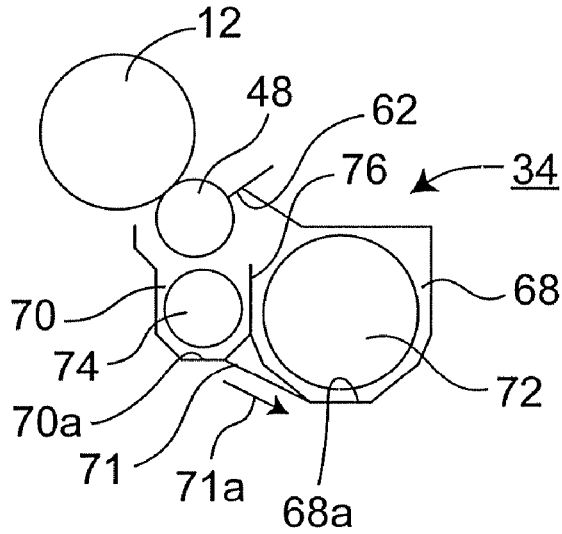
FIG. 20A is a schematic side view showing the developing device as seen from the side of a developer discharging section according to a ninth embodiment of the present invention.
Figure 20B:
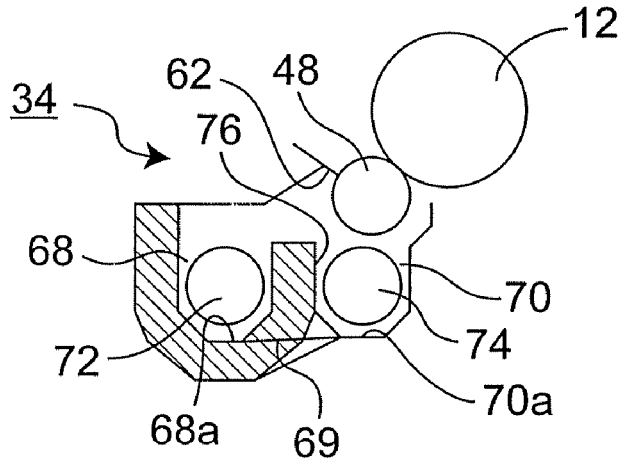
FIG. 20B is a schematic side view showing the developing device as seen from the opposite side of the developer discharging section according to the ninth embodiment of the present invention.
Figure 20C:
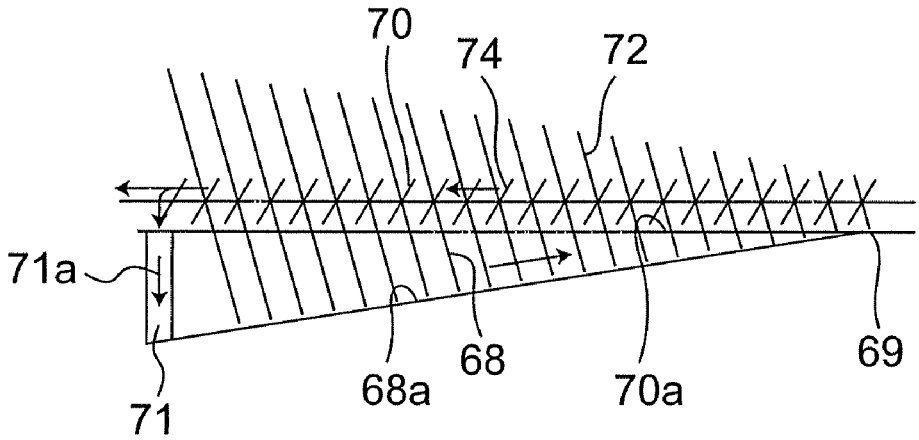
FIG. 20C is a schematic view showing the developing device as seen from the side according to the ninth embodiment of the present invention.

FIG. 20A is a schematic side view showing the developing device 34 as seen from the side of the developer discharging section 79 according to the ninth embodiment of the present invention, FIG. 20B is a schematic side view showing the developing device 34 as seen from the opposite side of the developer discharging section 79 according to the ninth embodiment of the present invention, and FIG. 20C is a schematic view showing the developing device 34 as seen from the side according to the ninth embodiment of the present invention.

The developing device 34 according to the ninth embodiment shown in FIGS. 20A, 20B, and 20C is a variation example of the above-mentioned second embodiment and is configured such that the bottom face 70*a* of the upper conveying passage 70 extends on a nearly horizontal plane, such that the bottom face 68*a* of the lower conveying passage 68 is tilted obliquely upward as seen from the developer discharging section 79, such that the outside diameter of the first screw 72 (lower stirring member) is larger than the outside diameter of the second screw 74 (upper stirring member), and such that the outside diameter of the first screw 72 (lower stirring member) gradually becomes smaller toward the first communicating passage 71, that is, the outside diameter is reduced.

In the example shown in FIGS. 20A, 20B, and 20C, the rotation shaft of the first screw 72 (lower stirring member) and the rotation shaft of the second screw 74 (upper stirring member) extend on nearly identical horizontal planes; however, the two rotation shafts are not necessarily required to extend on the nearly identical horizontal planes. Furthermore, the downstream side portion of the bottom face 68*a* of the lower conveying passage 68 and the upstream side portion of the bottom face 70*a* of the upper conveying passage 70, being connected to each other using the second communicating passage 69, extend on nearly identical horizontal planes; however, the downstream side portion of the bottom face 68*a* and the upstream side portion of the bottom face 70*a*, being connected to the second communicating passage 69, are not necessarily required to extend on the nearly identical horizontal planes; the downstream side portion of the bottom face 68*a* may be configured so as to be higher than the upstream side portion of the bottom face 70*a*.

The bottom face 70*a* of the upper conveying passage 70 extending in a nearly horizontal direction is positioned at a level nearly as high as or higher than the bottom face 68*a* of the lower conveying passage 68. In the bottom face 68*a* of the lower conveying passage 68, the discharge side thereof, that is, the side of the first communicating passage 71, is disposed low, and the side on the opposite side of the discharge side, that is, the side on the second communicating passage 68, is disposed high. Hence, the bottom face 68*a* of the lower conveying passage 68 is tilted obliquely upward with respect to the horizontal plane as seen from the side of the developer discharging section 79.

The obliquely downward arrow 71*a* in FIG. 20A indicates the obliquely downward flow of the developer-tank-contained developer 3 that is conveyed along the first communicating passage 71. In FIG. 20C, the arrow branched leftward on the discharge side of the developing device 34 indicates the flow of the developer-tank-contained developer 3 that is conveyed toward the developer discharging section 79, and the arrow branched downward on the discharge side of the developing device 34 indicates the flow of the developer-tank-contained developer 3 that is conveyed toward the first communicating passage 71. Hence, as shown in FIG. 20C, part of the developer-tank-contained developer 3 is conveyed obliquely downward in the first communicating passage 71, conveyed obliquely upward in the lower conveying passage 68, conveyed in the second communicating passage 69 in a nearly horizontal direction, and conveyed in the upper conveying passage 70 in a nearly horizontal direction; and the other part of the developer-tank-contained developer 3 is conveyed toward the developer discharging section 79.

Even if the outside diameter of the first screw 72 (lower stirring member) is configured so as to be larger than the outside diameter of the second screw 74 (upper stirring member) and so as to gradually become smaller from the side of the first communicating passage 71 to the side of the second communicating passage 69, the first communicating passage 71 tilted obliquely downward with respect to the horizontal plane can be formed. Excessive discharge of the developer-tank-contained developer 3 to the developer discharging section 79 can be restricted using the first communicating passage 71 even when the developing device 34 is tilted such that the discharge side thereof is positioned low. Furthermore, since the downstream side portion of the bottom face 68*a* is positioned at a level as high as or higher than the upstream side portion of the bottom face 70*a*, it is not necessary to push up the developer-tank-contained developer 3 along the second communicating passage 69, whereby the rotation drive torque applied when the first screw 72 (lower stirring member) is driven and rotated is reduced.

Next, the characteristic sections of the developing device 34 and the operations thereof according to a tenth embodiment of the present invention will be described referring to FIGS. 21A, 21B, and 21C. However, since the configurations of the sections other than those of the characteristic sections according to the tenth embodiment are the same as those according to the above-mentioned sixth embodiment, the description regarding the configurations of the sections other than those of the characteristic sections is omitted.

Figure 21A:
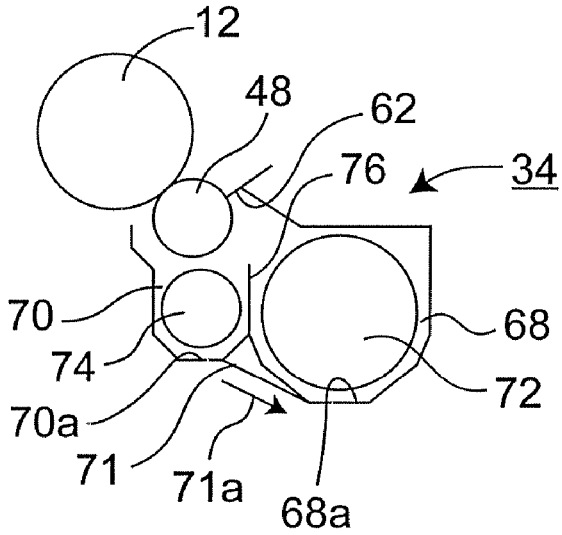
FIG. 21A is a schematic side view showing the developing device as seen from the side of a developer discharging section according to a tenth embodiment of the present invention.
Figure 21B:
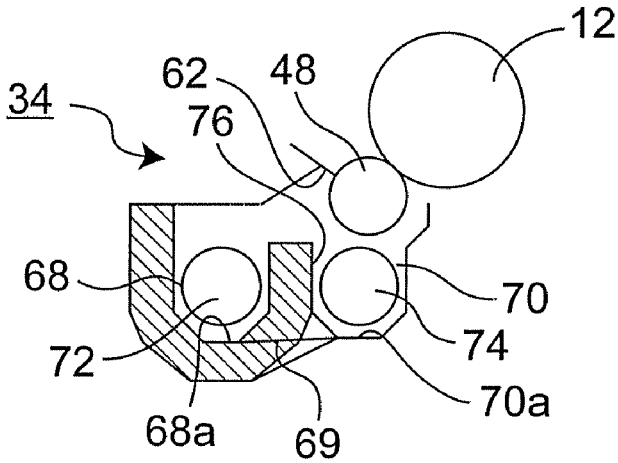
FIG. 21B is a schematic side view showing the developing device as seen from the opposite side of the developer discharging section according to the tenth embodiment of the present invention.
Figure 21C:
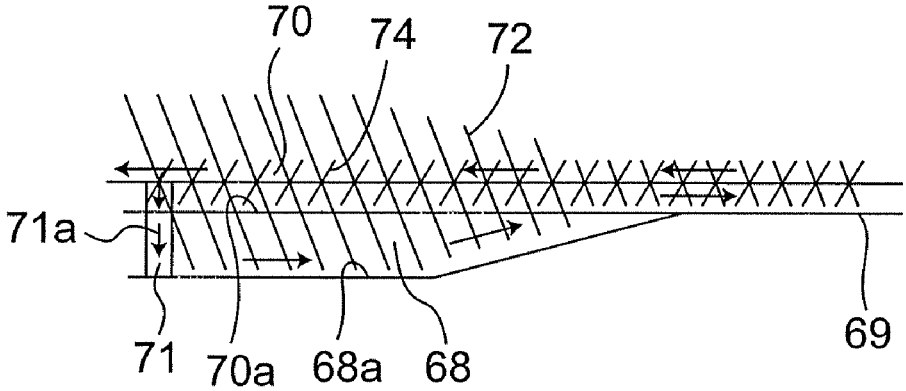
FIG. 21C is a schematic view showing the developing device as seen from the side according to the tenth embodiment of the present invention.

FIG. 21A is a schematic side view showing the developing device 34 as seen from the side of the developer discharging section 79 according to the tenth embodiment of the present invention, FIG. 21B is a schematic side view showing the developing device 34 as seen from the opposite side of the developer discharging section 79 according to the tenth embodiment of the present invention, and FIG. 21C is a schematic view showing the developing device 34 as seen from the side according to the tenth embodiment of the present invention.

The developing device 34 according to the tenth embodiment shown in FIGS. 21A, 21B, and 21C is a variation example of the above-mentioned ninth embodiment and is configured such that the bottom face 70*a* of the upper conveying passage 70 extends on a nearly horizontal plane, such that the bottom face 68*a* of the lower conveying passage 68 is tilted obliquely upward as seen from the side of the developer discharging section 79, such that the outside diameter of the first screw 72 (lower stirring member) is larger than the outside diameter of the second screw 74 (upper stirring member) at the portion on the side of the first communicating passage 71, is nearly identical with the outside diameter of the first screw 72 (lower stirring member) at the portion on the side of the second communicating passage 69 and gradually becomes smaller in the intermediate portion.

In the example shown in FIGS. 21A, 21B, and 21C, the rotation shaft of the first screw 72 (lower stirring member) and the rotation shaft of the second screw 74 (upper stirring member) extend on nearly identical horizontal planes; however, the two rotation shafts are not necessarily required to extend on the nearly identical horizontal planes. Furthermore, the downstream side portion of the bottom face 68*a* of the lower conveying passage 68 and the upstream side portion of the bottom face 70*a* of the upper conveying passage 70, being connected to each other using the second communicating passage 69, extend on nearly identical horizontal planes; however, the downstream side portion of the bottom face 68*a* and the upstream side portion of the bottom face 70*a*, being connected to the second communicating passage 69, are not necessarily required to extend on the nearly identical horizontal planes; the downstream side portion of the bottom face 68*a* may be configured so as to be higher than the upstream side portion of the bottom face 70*a*.

The bottom face 70*a* of the upper conveying passage 70 extending in a nearly horizontal direction is positioned at a level nearly as high as or higher than the bottom face 68*a* of the lower conveying passage 68. In the bottom face 68*a* of the lower conveying passage 68, the portion on the discharge side, that is, on the side of the first communicating passage 71, extends in a nearly horizontal direction and is disposed below the other portions. The portion on the opposite side of the discharge side, that is, the portion on the side of the second communicating passage 68, extends in a nearly horizontal direction and is disposed above the other portions. The intermediate portion of the bottom face 68*a* of the lower conveying passage 68 extends obliquely upward. Hence, the bottom face 68*a* of the lower conveying passage 68 has a portion extending in a nearly horizontal direction, a portion tilted obliquely upward with respect to the horizontal plane, and a portion extending in a nearly horizontal direction as seen from the side of the developer discharging section 79.

The obliquely downward arrow 71*a* in FIG. 21A indicates the obliquely downward flow of the developer-tank-contained developer 3 that is conveyed along the first communicating passage 71. In FIG. 21C, the arrow branched leftward on the discharge side of the developing device 34 indicates the flow of the developer-tank-contained developer 3 that is conveyed toward the developer discharging section 79, and the arrow branched downward on the discharge side of the developing device 34 indicates the flow of the developer-tank-contained developer 3 that is conveyed toward the first communicating passage 71. Hence, as shown in FIG. 21C, part of the developer-tank-contained developer 3 is conveyed obliquely downward in the first communicating passage 71, sequentially conveyed in a nearly horizontal direction, obliquely upward and in a nearly horizontal direction in the lower conveying passage 68, conveyed in the second communicating passage 69 in a nearly horizontal direction, and conveyed in the upper conveying passage 70 in a nearly horizontal direction; and the other part of the developer-tank-contained developer 3 is conveyed toward the developer discharging section 79.

Even if the outside diameter of the first screw 72 (lower stirring member) is configured so as to be larger than the outside diameter of the second screw 74 (upper stirring member) at the portion on the side of the first communicating passage 71, so as to be nearly identical with the outside diameter of the second screw 74 (upper stirring member) at the portion on the side of the second communicating passage 69 and so as to gradually become smaller at the intermediate portion, the first communicating passage 71 tilted obliquely downward with respect to the horizontal plane can be formed. Excessive discharge of the developer-tank-contained developer 3 to the developer discharging section 79 can be restricted using the first communicating passage 71 even when the developing device 34 is tilted such that the discharge side thereof is positioned low. Furthermore, since the downstream side portion of the bottom face 68*a* is positioned at a level as high as or higher than the upstream side portion of the bottom face 70*a*, it is not necessary to push up the developer-tank-contained developer 3 along the second communicating passage 69, whereby the rotation drive torque applied when the first screw 72 (lower stirring member) is driven and rotated is reduced.

As described above, the developing device 34 according to the present invention is equipped with the first communicating passage 71 tilted obliquely downward with respect to the horizontal plane. Hence, how the flow of the developer-tank-contained developer 3 was changed by the change in the tilt angle β of the first communicating passage 71 with respect to the horizontal plane was examined for the respective developing devices 34 according to the above-mentioned sixth to tenth embodiments.

Figure 22:
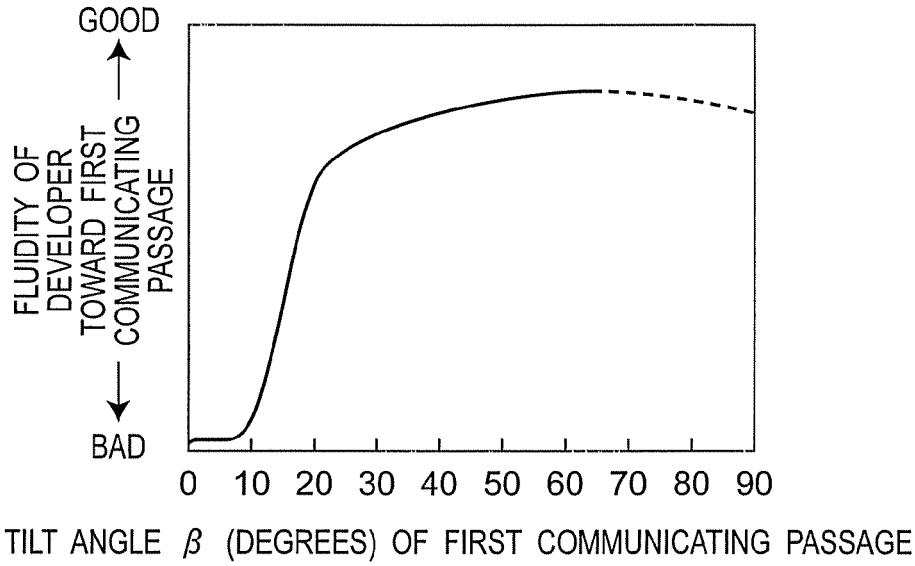
FIG. 22 is a graph illustrating the relationship between the tilt angle of the first communicating passage and the fluidity of the developer toward the first communicating passage in the developing device according to the present invention.

FIG. 22 is a graph illustrating the relationship between the tilt angle β of the first communicating passage 71 and the fluidity of the developer-tank-contained developer 3 toward the first communicating passage 71 in the developing device according to the sixth embodiment. In FIG. 22, the horizontal axis represents the tilt angle β of the first communicating passage 71 with respect to the horizontal plane, and the vertical axis represents the fluidity of the developer-tank-contained developer 3. In this graph, the state that the tilt angle β of the first communicating passage 71 is 0 degrees means that the first communicating passage 71 extends in a horizontal direction, corresponding to the developing device according to the prior art shown in FIG. 16. In addition, the state that the tilt angle β of the first communicating passage 71 is 90 degrees means that the first communicating passage 71 extends in a vertical direction, wherein the developer-tank-contained developer 3 is conveyed so as to fall along the first communicating passage 71 and is thus hardly conveyed to the side of the developer discharging section 79.

The solid line in the range of the tilt angle β from 0 to 60 degrees in FIG. 22 was obtained by actually measuring whether the flow of the developer-tank-contained developer 3 is good or bad. As shown in FIG. 22, the fluidity of the developer-tank-contained developer 3 in the range of the tilt angle β from 0 to approximately 9 degrees is not so good, but the fluidity of the developer-tank-contained developer 3 in the range of the tilt angle β from approximately 10 to approximately 60 degrees is good. In particular, the fluidity of the developer-tank-contained developer 3 in the range of the tilt angle β from approximately 20 to approximately 40 degrees is very good.

Furthermore, in the developing device according to the seventh embodiment, whether the fluidity of the developer-tank-contained developer 3 toward the first communicating passage 71 is good or bad was examined when the ratio of the outside diameter of the first screw 72 (lower stirring member) to the outside diameter of the second screw 74 (upper stirring member) and the tilt angle β were changed, and the results are shown in Tables 1 to 3. In Tables 1 to 3, mark ◎ indicates that the fluidity of the developer-tank-contained developer 3 is very good, mark ○ indicates that the fluidity of the developer-tank-contained developer 3 is good, mark Δ indicates that the fluidity of the developer-tank-contained developer 3 is not so good, and mark x indicates that the fluidity of the developer-tank-contained developer 3 is bad.

TABLE 1

| The ratio of the outside diameter of the first screw 72 to the outside diameter of the second screw 74 | The tilt angle β (degrees) of the first communicating passage | | | | |
|---|---|---|---|---|---|
| | 0 | 15 | 30 | 45 | 60 |
| 1.00 | X | ○ | ◎ | ○ | ○ |

TABLE 2

| The ratio of the outside diameter of the first screw 72 to the outside diameter of the second screw 74 | The tilt angle β (degrees) of the first communicating passage | | | |
|---|---|---|---|---|
| | 10.5 | 25.5 | 40.5 | 55.5 |
| 1.57 | ○ | ◎ | ○ | ○ |

TABLE 3

| The ratio of the outside diameter of the first screw 72 to the outside diameter of the second screw 74 | The tilt angle β (degrees) of the first communicating passage | | | |
|---|---|---|---|---|
| | 10.5 | 25.5 | 40.5 | 55.5 |
| 2.43 | ◎ | ◎ | ○ | Δ |

As shown in Table 1, when the outside diameter of the first screw 72 (lower stirring member) is equal to the outside diameter of the second screw 74 (upper stirring member) and when the tilt angle β is 0 degrees, the fluidity of the developer-tank-contained developer 3 is bad; however, when the tilt angle β is in the range of 15 to 60 degrees, the fluidity of the developer-tank-contained developer 3 is good. In particular, when the tilt angle β is 30 degrees, the fluidity of the developer-tank-contained developer 3 is very good. As shown in Table 2, when the outside diameter of the first screw 72 (lower stirring member) is 1.57 times the outside diameter of the second screw 74 (upper stirring member) and when the tilt angle β is in the range of 10.5 to 55.5 degrees, the fluidity of the developer-tank-contained developer 3 is good. In particular, when the tilt angle β is 25.5 degrees, the fluidity of the developer-tank-contained developer 3 is very good. Furthermore, as shown in Table 3, when the outside diameter of the first screw 72 (lower stirring member) is 2.43 times the outside diameter of the second screw 74 (upper stirring member) and when the tilt angle β is 65.9 degrees, the fluidity of the developer-tank-contained developer 3 is not so good; however, when the tilt angle β is in the range of 20.9 to 50.9 degrees, the fluidity of the developer-tank-contained developer 3 is good. In particular, when the tilt angle β is in the range of 20.9 to 35.9 degrees, the fluidity of the developer-tank-contained developer 3 is very good.

In the respective developing devices 34 according to the sixth to tenth embodiments, results similar to the results shown in FIG. 22 were obtained.

Next, the characteristic sections of the developing device 34 and the operations thereof according to an 11th embodiment of the present invention will be described referring to FIG. 23. However, since the configurations of the sections other than those of the characteristic sections according to the 11th embodiment are the same as those according to the above-mentioned respective embodiments, the description regarding the configurations of the sections other than those of the characteristic sections is omitted.

Figure 23:
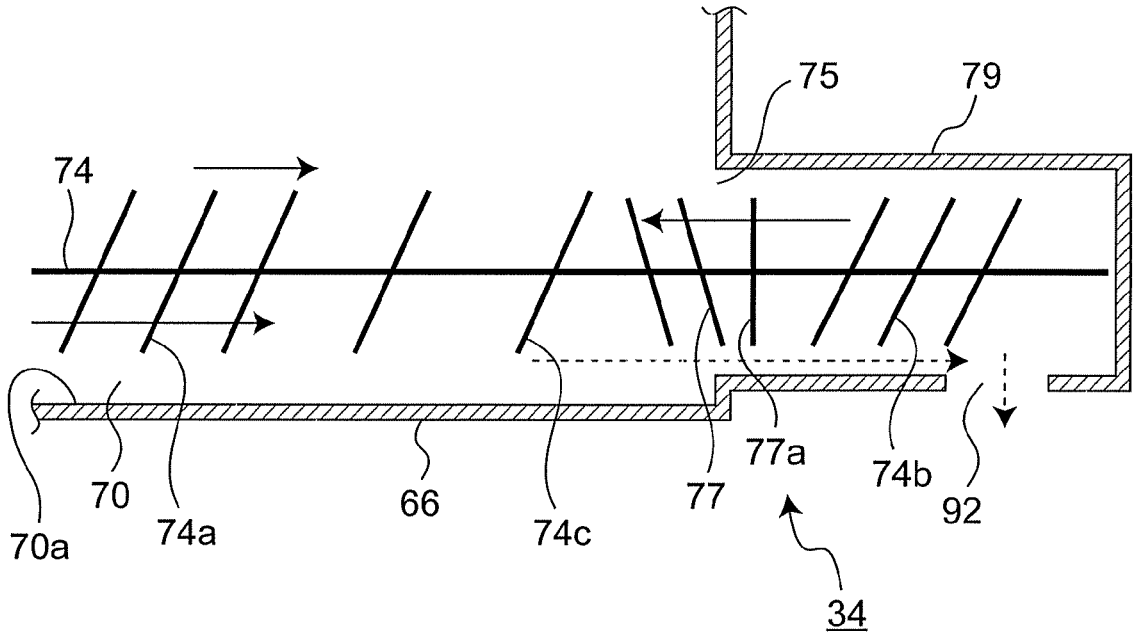
FIG. 23 is a view showing the schematic configuration of an image forming apparatus according to an 11th embodiment of the present invention.

FIG. 23 is a schematic sectional view showing part of the developing device 34 according to the 11th embodiment of the present invention as seen from the side.

When the developer-tank-contained developer 3 is conveyed in a consolidated state in the upper conveying passage 70, the fluidity of the developer-tank-contained developer 3 lowers, and the developer-tank-contained developer 3 tends to easily advance in the straight-ahead direction in which the second screw 74 (upper stirring member) of the upper conveying passage 70 extends, that is, in the direction toward the developer discharging section 79, but tends to hardly advance to the first communicating passage 71 that is disposed so as to be nearly orthogonal to the upper conveying passage 70. In other words, if the fluidity of the developer-tank-contained developer 3 is low, the developer-tank-contained developer 3 is conveyed toward the developer discharging section 79 rather than toward the first communicating passage 71.

In order that the developer-tank-contained developer 3 is easily conveyed to the first communicating passage 71, it is desired to raise the fluidity of the developer-tank-contained developer 3. For this purpose, it is desirable that the pitch at the portion of the second screw 74 (upper stirring member) close to the developer discharging section 79 is larger than that of the other portion of the second screw 74 (upper stirring member). As the pitch of the screw is larger, the conveying speed of the developer-tank-contained developer 3 becomes higher, and an air gap is apt to be formed easily between the developer-tank-contained developer 3 and the developer-tank-contained developer 3 adjacent thereto. The fact that the air gap is formed between the developer-tank-contained developer 3 and the developer-tank-contained developer 3 adjacent thereto means that ambient air is apt to be held easily in the developer-tank-contained developer 3. Therefore, as the pitch of the screw is larger, the fluidity of the developer-tank-contained developer 3 becomes higher.

Hence, as shown in FIG. 23, the pitch in the pitch-enlarged screw section 74*c* on the downstream side of the second screw 74 (upper stirring member) is configured so as to be larger than the ordinary pitch in the other portions (the conveying forward screw section 74*a* and the reverse screw section 77). If the pitch-enlarged screw section 74*c* exists in a long distance, the developer-tank-contained developer 3 is mixed/stirred insufficiently; or if the second screw 74 is long, the developing device 34 becomes large in size, thereby being disadvantageous in design; for these reasons, it is undesirable that the pitch-enlarged screw section 74*c* extends in a distance longer than necessary. The pitch in the pitch-enlarged screw section 74*c* is preferably 1.2 to 2.5 times the ordinary pitch in the other portions, for example, and further preferably 1.5 to 2 times. Furthermore, the pitch-enlarged screw section 74*c* extends from the portion on the upstream side slightly ahead of the first communicating passage 71 to the portion overlapped with the first communicating passage 71.

In the respective embodiments 6 to 10 described above, it has been verified that the developer-tank-contained developer 3 is easily conveyed to the first communicating passage 71 by providing the pitch-enlarged screw section 74*c* for the second screw 74 (upper stirring member). In other words, it has been verified that the developer-tank-contained developer 3 is guided to the first communicating passage 71 without greatly increasing the tilt angle β of the first communicating passage 71. For this reason, the design freedom of the developing device 34 can be increased.

In the respective embodiments, the description is given on the premise that the bottom face 70*a* of the upper conveying passage 70 is configured so as to extend in a nearly horizontal direction; however, the present invention is not necessarily limited to this kind of configuration. The present invention is characterized in that the bottom face on the downstream side of the upper conveying passage is positioned above the bottom face on the upstream side of the lower conveying passage and that the first communicating passage is disposed obliquely downward with respect to the horizontal plane; as long as this kind of configuration is satisfied, the bottom face 70*a* of the upper conveying passage 70 and the bottom face 68*a* of the lower conveying passage 68 can be disposed variously. The disposition relationship between the bottom face 70*a* of the upper conveying passage 70 and the bottom face 68*a* of the lower conveying passage 68 is only relative. The bottom face 70*a* of the upper conveying passage 70 is not limited to extend in the horizontal direction, but may be configured so as to tilt upward or downward on the side of the developer discharging section 79, for example. In this case, the bottom face 68*a* of the lower conveying passage 68 may be configured so as to extend in the horizontal direction or so as to tilt with respect to the horizontal plane. Alternatively, both the bottom face 70*a* of the upper conveying passage 70 and the bottom face 68*a* of the lower conveying passage 68 may be configured so as to extend obliquely parallel.

In addition, the circulation direction of the developer-tank-contained developer 3 in the circulation passage, the dispositions of the replenishment-related components, such as the developer replenishing tank 80 and the replenishing port 82, and the dispositions of the image formation-related components, such as the developing roller 48 (developer holder) are not limited to have the above-mentioned configurations. The circulation direction of the developer-tank-contained developer 3 and the dispositions of the replenishment-related components and the image formation-related components are determined appropriately such that the replenishing developer 2 is not conveyed immediately to the developing roller 48 (developer holder) without being stirred/mixed sufficiently.

Hence, it is possible to have a configuration in which after the replenishing developer 2 is replenished to the upstream side of the lower conveying passage 68 not opposed to the developing roller 48 (developer holder), the mixed/stirred developer-tank-contained developer 3 is conveyed to the upper conveying passage 70 opposed to the developing roller 48 (developer holder) and discharged from the downstream side of the upper conveying passage 70. Alternatively, it is also possible to have a configuration in which after the replenishing developer 2 is replenished to the downstream side of the conveying passage opposed to the developing roller 48 (developer holder), the mixed/stirred developer-tank-contained developer 3 is conveyed to the conveying passage opposed to the developing roller 48 (developer holder) and further conveyed to the upstream side of the conveying passage opposed to the developing roller 48 (developer holder).

What is claimed is:

1. A developing device having stirring members for stirring a developer-tank-contained developer containing toner and carrier inside a developer tank while conveying the developer along conveying passages and a developer holder disposed adjacent to said stirring members to supply the stirred developer-tank-contained developer to an electrostatic latent image holder, comprising:

a developer replenishing tank for replenishing the toner and the carrier to said developer tank, and a discharging mechanism for discharging an excessive amount of the developer-tank-contained developer outside said developer tank from a discharge opening section when the amount of the developer-tank-contained developer to be conveyed using said stirring members inside said developer tank exceeds a predetermined amount, wherein said stirring members comprises an upper stirring member and a lower stirring member disposed so as to be opposed to said upper stirring member, said conveying passages include an upper conveying passage in which said upper stirring member is disposed, a lower conveying passage in which said lower stirring member is disposed, a circulating flow outlet provided in a side wall on the downstream side of said upper conveying passage and on the side opposed to said lower conveying passage and a communicating passage for connecting the downstream side of said lower conveying passage to the upstream side of said upper conveying passage, and also include a circulation passage through which the developer-tank-contained developer circulates using said upper conveying passage, said circulating flow outlet, said lower conveying passage and said communicating passage, said discharging mechanism is disposed in the downstream end section of said upper conveying passage, said circulating flow outlet is positioned above the level of the developer-tank-contained developer conveyed on the upstream side of said lower conveying passage, and the circulating flow outlet is formed by cutting out an upper portion of a partition wall for partitioning the space between the lower conveying passage and the upper conveying passage, so that the developer-tank-contained developer is configured so as to climb over an upper end section of the cut out partition wall and to flow down toward the lower conveying passage like a waterfall.

2. The developing device according to claim 1, wherein the bottom face of said upper conveying passage is substantially parallel with the bottom face of said lower conveying passage, and the outside diameter of said lower stirring member is larger than the outside diameter of said upper stirring member.

3. The developing device according to claim 1, wherein the distance between the bottom face of said upper conveying passage and the bottom face of said lower conveying passage becomes larger on the side of said circulating flow outlet and becomes smaller on the side of said communicating passage, and the outside diameter of said upper stirring member is substantially identical with the outside diameter of said lower stirring member.

4. The developing device according to claim 1, wherein the distance between the bottom face of said upper conveying passage and the bottom face of said lower conveying passage becomes larger on the side of said circulating flow outlet and becomes smaller on the side of said communicating passage, and the outside diameter of said lower stirring member is larger than the outside diameter of said upper stirring member on the side of said circulating flow outlet.

5. The developing device according to claim 1, wherein the distance between the bottom face of said upper conveying passage and the bottom face of said lower conveying passage becomes larger on the side of said circulating flow outlet and becomes smaller on the side of said communicating passage, and the outside diameter of said lower stirring member is large at the portion on the side of said circulating flow outlet, is small at the portion on the side of said communicating passage and gradually becomes smaller in the intermediate portion thereof.

6. The developing device according to claim 1, wherein the pitch at the portion of said upper stirring member close to said discharging mechanism is larger than that at the other portions of said upper stirring member.

7. An image forming apparatus comprising said developing device according to claim 1 and a rotatable electrostatic latent image holder for holding electrostatic latent images on the circumferential face thereof.

8. The developing device according to claim 6, wherein the bottom face of said upper conveying passage is substantially parallel with the bottom face of said lower conveying passage, and the outside diameter of said lower stirring member is larger than the outside diameter of said upper stirring member.

9. The developing device according to claim 6, wherein the distance between the bottom face of said upper conveying passage and the bottom face of said lower conveying passage becomes larger on the side of said circulating flow outlet and becomes smaller on the side of said communicating passage, and the outside diameter of said upper stirring member is substantially identical with the outside diameter of said lower stirring member.

10. The developing device according to claim 6, wherein the distance between the bottom face of said upper conveying passage and the bottom face of said lower conveying passage becomes larger on the side of said circulating flow outlet and becomes smaller on the side of said communicating passage, and the outside diameter of said lower stirring member is larger than the outside diameter of said upper stirring member on the side of said circulating flow outlet.

11. The developing device according to claim 6, wherein the distance between the bottom face of said upper conveying passage and the bottom face of said lower conveying passage becomes larger on the side of said circulating flow outlet and becomes smaller on the side of said communicating passage, and the outside diameter of said lower stirring member is large at the portion on the side of said circulating flow outlet, is small at the portion on the side of said communicating passage and gradually becomes smaller in the intermediate portion thereof.

12. The developing device according to claim 6, which comprises a rotatable electrostatic latent image holder for holding electrostatic latent images on the circumferential face thereof.

13. A developing device having stirring members for stirring a developer-tank-contained developer containing toner and carrier inside a developer tank while conveying the developer along conveying passages and a developer holder disposed adjacent to said stirring members to supply the stirred developer-tank-contained developer to an electrostatic latent image holder, comprising:

a developer replenishing tank for replenishing the toner and the carrier to said developer tank, and a discharging mechanism for discharging an excessive amount of the developer-tank-contained developer outside said developer tank from a discharge opening section when the amount of the developer-tank-contained developer to be conveyed using said stirring members inside said developer tank exceeds a predetermined amount, wherein said stirring members comprises an upper stirring member and a lower stirring member disposed so as to be opposed to said upper stirring member, said conveying passages include an upper conveying passage in which said upper stirring member is disposed, a lower conveying passage in which said lower stirring member is disposed, a first communicating passage for connecting the downstream side of said upper conveying passage to the upstream side of said lower conveying passage and a second communicating passage for connecting the downstream side of said lower conveying passage to the upstream side of said upper conveying passage, and also include a circulation passage through which the developer-tank-contained developer circulates using said upper conveying passage, said first communicating passage, said lower conveying passage and said second communicating passage, said discharging mechanism is disposed in the downstream end section of said upper conveying passage, the bottom face on the downstream side of said upper conveying passage is positioned above the bottom face on the upstream side of said lower conveying passage, said first communicating passage is disposed obliquely downward with respect to the horizontal plane, and the first communicating passage is tilted obliquely downward with respect to the horizontal plane at a tilt angle of 10 to 60 degrees.

14. The developing device according to claim 13, wherein the bottom face of said upper conveying passage is substantially parallel with the bottom face of said lower conveying passage.

15. The developing device according to claim 14, wherein the outside diameter of said upper stirring member is substantially identical with the outside diameter of said lower stirring member.

16. The developing device according to claim 14, wherein the outside diameter of said lower stirring member is larger than the outside diameter of said upper stirring member.

17. The developing device according to claim 13, wherein the distance between the bottom face of said upper conveying passage and the bottom face of said lower conveying passage becomes larger on the side of said first communicating passage and becomes smaller on the side of said second communicating passage.

18. The developing device according to claim 17, wherein the outside diameter of said upper stirring member is substantially identical with the outside diameter of said lower stirring member.

19. The developing device according to claim 17, wherein the outside diameter of said lower stirring member is larger than the outside diameter of said upper stirring member on the side of said first communicating passage.

20. The developing device according to claim 18, wherein the outside diameter of said lower stirring member gradually becomes smaller from the side of said first communicating passage toward the side of said second communicating passage.

21. The developing device according to claim 18, wherein the outside diameter of said lower stirring member is large at the portion on the side of said first communicating passage, is small at the portion on the side of said second communicating passage and gradually becomes small at the intermediate portion thereof.

22. The developing device according to claim 13, wherein the first communicating passage is tilted obliquely downward with respect to the horizontal plane at a tilt angle of 20 to 40 degrees.

23. The developing device according to claim 13, wherein the pitch at the portion of said upper stirring member close to said discharging mechanism is larger than that at the other portions of said upper stirring member.

24. An image forming apparatus comprising said developing device according to claim 13 and a rotatable electrostatic latent image holder for holding electrostatic latent images on the circumferential face thereof.

25. A developing device having stirring members for stirring a developer-tank-contained developer containing toner and carrier inside a developer tank while conveying the developer along conveying passages and a developer holder disposed adjacent to said stirring members to supply the stirred developer-tank-contained developer to an electrostatic latent image holder, comprising:

a developer replenishing tank for replenishing the toner and the carrier to said developer tank, and a discharging mechanism for discharging an excessive amount of the developer-tank-contained developer outside said developer tank from a discharge opening section when the amount of the developer-tank-contained developer to be conveyed using said stirring members inside said developer tank exceeds a predetermined amount, wherein said stirring members comprises an upper stirring member and a lower stirring member disposed so as to be opposed to said upper stirring member, said conveying passages include an upper conveying passage in which said upper stirring member is disposed, a lower conveying passage in which said lower stirring member is disposed, a circulating flow outlet provided in a side wall on the downstream side of said upper conveying passage and on the side opposed to said lower conveying passage and a communicating passage for connecting the downstream side of said lower conveying passage to the upstream side of said upper conveying passage, and also include a circulation passage through which the developer-tank-contained developer circulates using said upper conveying passage, said circulating flow outlet, said lower conveying passage and said communicating passage, said discharging mechanism is disposed in the downstream end section of said upper conveying passage, said circulating flow outlet is positioned above the level of the developer-tank-contained developer conveyed on the upstream side of said lower conveying passage, and the distance between the bottom face of said upper conveying passage and the bottom face of said lower conveying passage becomes larger on the side of said circulating flow outlet and becomes smaller on the side of said communicating passage, and the outside diameter of said lower stirring member is large at the portion on the side of said circulating flow outlet, is small at the portion on the side of said communicating passage and gradually becomes smaller in the intermediate portion thereof.

26. A developing device having stirring members for stirring a developer-tank-contained developer containing toner and carrier inside a developer tank while conveying the developer along conveying passages and a developer holder disposed adjacent to said stirring members to supply the stirred developer-tank-contained developer to an electrostatic latent image holder, comprising:

a developer replenishing tank for replenishing the toner and the carrier to said developer tank, and a discharging mechanism for discharging an excessive amount of the developer-tank-contained developer outside said developer tank from a discharge opening section when the amount of the developer-tank-contained developer to be conveyed using said stirring members inside said developer tank exceeds a predetermined amount, wherein said stirring members comprises an upper stirring member and a lower stirring member disposed so as to be opposed to said upper stirring member, said conveying passages include an upper conveying passage in which said upper stirring member is disposed, a lower conveying passage in which said lower stirring member is disposed, a circulating flow outlet provided in a side wall on the downstream side of said upper conveying passage and on the side opposed to said lower conveying passage and a communicating passage for connecting the downstream side of said lower conveying passage to the upstream side of said upper conveying passage, and also include a circulation passage through which the developer-tank-contained developer circulates using said upper conveying passage, said circulating flow outlet, said lower conveying passage and said communicating passage, said discharging mechanism is disposed in the downstream end section of said upper conveying passage, said circulating flow outlet is positioned above the level of the developer-tank-contained developer conveyed on the upstream side of said lower conveying passage, and the pitch at the portion of said upper stirring member close to said discharging mechanism is larger than that at the other portions of said upper stirring member.

* * * * *